United States Patent [19]

Maekawa et al.

[11] Patent Number: 5,067,550

[45] Date of Patent: Nov. 26, 1991

[54] MANUFACTURING METHOD FOR DEFECT-FREE CASTING PRODUCT

[75] Inventors: Shigeki Maekawa; Mikio Yamashita; Kenji Kawaguchi; Yuji Kobayashi, all of Amagasaki, Japan

[73] Assignee: Mitsubishi Denki Kabushiki Kaisha, Tokyo, Japan

[21] Appl. No.: 487,291

[22] Filed: Mar. 2, 1990

[30] Foreign Application Priority Data

| | | | |
|---|---|---|---|
| Mar. 6, 1989 | [JP] | Japan | 1-54405 |
| Nov. 14, 1989 | [JP] | Japan | 1-296828 |
| Nov. 14, 1989 | [JP] | Japan | 1-296829 |

[51] Int. Cl.[5] ..... B22D 27/11

[52] U.S. Cl. ..... 164/120; 164/319; 164/320

[58] Field of Search ..... 164/120, 319, 320

[56] References Cited

FOREIGN PATENT DOCUMENTS

| | | | |
|---|---|---|---|
| 59-100236 | 6/1984 | Japan | 164/120 |
| 61-49764 | 3/1986 | Japan | 164/120 |
| 61-276762 | 12/1986 | Japan | 164/120 |
| 725806 | 4/1980 | U.S.S.R. | 164/120 |
| 2072065 | 9/1981 | United Kingdom | 164/120 |
| 2133330 | 7/1984 | United Kingdom | 164/120 |

*Primary Examiner*—Kuang Y. Lin

*Attorney, Agent, or Firm*—Leydig, Voit & Mayer

[57] ABSTRACT

A manufacturing method for a defect-free cast product comprises the steps of forming a cavity surrounded by a plurality of dies, charging molten conductive material into the cavity, and applying pressure to the conductive material by pressure means. In the method, additional pressure is selectively applied to the portion of the conductive material which may suffer shrinkage cavities due to delay in solidification, by utilizing the pressure applied by the pressure means and by relatively moving a portion of the dies with respect to the conductive material when the conductive material solidifies and shrinks, whereby shrinkage cavities are prevented. Accordingly, with a cast rotor core obtained by this method, it is possible to prevent shrinkage cavities from occurring in the conductive material and it is also possible to improve the efficiency and torque characteristics of the motor, thereby achieving reductions in the size and weight of the motor.

26 Claims, 25 Drawing Sheets

MANUFACTURING METHOD FOR DEFECT-FREE CASTING PRODUCT

BACKGROUND OF THE INVENTION

1. Field of the Invention

The present invention relates to a defect-free cast product and a manufacturing method therefor and, more specifically, to a rotor conductor free from shrinkage cavities which is produced by charging a rotor core with a molten conductive material under pressure and a manufacturing method therefor.

2. Description of the Related Art

FIGS. 1A and 1B are a partially broken away front elevational view and a side elevational view, respectively, showing the sameshowing a general squirrel-cage rotor before casting, that is, a rotor core. In the drawings, a rotor core 1 is formed by a plurality of steel disks 1*a* which are stacked in alignment, and has slots 1*b* and a rotary-shaft inserting portion 1*c* all of which extend through the rotor core 1 in the stacking direction. In a conventional manufacturing method, the squirrel-cage rotor 1 is produced by the steps of preparing a plurality of steel disks 1*a*, punching the slots 1*b* and the rotating-shaft inserting portion 1*c* in each of the steel disks 1*a*, stacking the required number of steel disks 1*a* in alignment to prepare the rotor core 1, forming rotor conductors (made of slot conductors and end rings) by an aluminum die-casting process, and inserting a rotary shaft.

FIG. 2 is a cross-sectional view showing the conventional casting apparatus for such a squirrel-cage rotor disclosed in, for example, Japanese Patent Application Laid-Open No. 56-47555. In the drawing, a temporary holding shaft 2 and a collar 3 cooperate to fasten the steel disks 1*a*, thereby assembling them into the aforesaid rotor core 1.

In a conventional die-casting process for a squirrel-cage rotor, the rotor core 1 assembled with the collar 3 and a nut 4 is inserted into a cylindrical bore extending through an intermediate die 10, and the intermediate die 10 and a top die 11 as a movable die are pressed against a bottom die 9 as a fixed die for clamping purposes. Then, a molten conductive material 6, such as molten aluminum poured into a sleeve 7, is pressed by a plunger 8 in order to apply a casting pressure through each of the slots 1*b* extending through the rotor core 1, whereby the slots 1*b* and the end ring portions are rapidly charged by the molten conductive material 6. The material 6 thus charged is quenched. Thereafter, the fixed die 9 is separated from the intermediate die 10 and, in order to extract the formed product, an extrusion rod 5 is operated to extrude the rotor core 1 provided with the slot conductors and the end rings. In FIG. 2, each arrow indicates the flow of the molten conductive material 6.

FIGS. 3A and 3B are a cross-sectional view and a side elevational view, respectively, showing the conventional squirrel-cage rotor produced by the aforesaid method. In the die-casting process described above, since the molten conductive material 6 is rapidly charged, air or gas inavoidably enters the charged conductive material 6. In addition, since it is impossible to maintain the high pressure until solidification is completed, shrinkage cavities 6*a* are formed in slot conductors 1*e* or end ring portions 1*d*, thus resulting in a decrease in the density of the rotor conductor. For instance, although the density of pure aluminum is 2.7 g/cm$^3$, the aluminum density of the conventional rotor conductor is as low as approximately 2.6 g/cm$^3$. This density decrease hinders conduction of the secondary current induced in the rotor, thereby reducing rotational torque. Accordingly, no design presently in use can cope with the density decrease (a decrease in electrical conduction due to shrinkage cavities) by satisfactorily utilizing the material characteristics of the rotor conductor. For this reason, to obtain the desired motor characteristics, it has been proposed to adopt various countermeasures such as an increase in the rotor diameter, an increase in the diameter of the primary stator winding and the like. However, all of these countermeasures involves an increase in the size of the motor itself, which hinders reductions in the size and weight of the rotor and, in addition, lead to an increase in cost because of the extra amount of material. Furthermore, the strength of the rotor decreases due to cavities formed in the slot conductors 1*e* and it is possible that the snapping of a wire or the breakage of the rotor conductor will take place during high-speed rotation.

To solve the above-described problems, a squeeze casting process (pressure solidification forging process) has recently been introduced. The liquid metal forging process typically comprises the steps of charging slots and spaces in which end rings are formed (hereinafter referred to as "end ring portion(s)"), with a molten conductive material, for example, molten aluminum at a reduced flow velocity, and solidifying the aforesaid molten aluminum under a high pressure of 400 kg/cm$^2$ or more.

FIG. 4 is a cross-sectional view showing the conventional squirrel-cage rotor forging apparatus disclosed in, for example, Japanese Patent Application Laid-Open No. 62-12357. In FIG. 4, a knockout punch 14 operates to move extrusion rods 5 up and down. A top die 11 is connected to pillars 17 and a slide 16 of a press (not shown) or the like. A liquid metal reservoir 9*a* for accommodating the molten aluminum 6 is formed in a bottom die 9, which is provided with the extrusion rods 5. The top die 11 and the bottom die 9 cooperate to define cavities 9*c* for receiving the rotor cores 1, respectively, and gates 9*b* for introducing the molten aluminum 6 into the cavities 9*c*. A bottom plate 21 for knockout is bolted to the knockout punch 14 supported by a bolster 20 of the press. Each gas discharge channel 41 is defined in flush with the top end of the cavity 9*c* and at a location opposite to the corresponding gate 9*b*. FIG. 5 is a fragmentary enlarged cross-sectional view showing a state wherein the molten aluminum 6 is charged by pressure when a top punch 15 is forced downward into the liquid metal reservoir 9*a* in the bottom die 9.

In the squeeze casting process for squirrel-cage rotors shown in FIGS. 4 and 5, a plurality of thin steel disks 1*a* are prepared each of which is punched with the rotary shaft inserting portion 1*c* and a plurality of slots 1*b* arranged in the circumferential direction. Then, this multiplicity of thin steel disks 1*a* is stacked in such a manner that the slots 1*b* are aligned in the stacking direction. Then, the top die 11 and the bottom die 9 are preheated to a temperature of about 250° C., and the rotor core 1 having the aforesaid slots 1*b* is inserted into each cavity 9*c* in the bottom die 9 in such a manner that the axes of the respective slots 1*b* coincide with the direction of gravity. In this state, the slide 16 is moved down to press the top die 11 connected thereto through the pillars 17 against the bottom die 9 for clamping purposes. Then, the molten aluminum 6 is poured into the liquid metal reservoir 9*a* in the bottom die 9 through a pouring port 11*a* formed in the top die 11 so that the liquid level does not exceed the plane of the gates 9*b*. Immediately thereafter, the top punch 15 is moved down to extrude the reserved molten aluminum 6, thereby charging it into the end ring portions of the slots 1*b* of the rotor core 1 positioned in each of the cavities 9*c*. The flow velocity of the molten aluminum 6 is controlled by controlling the speed of downward movement of the top punch 15. The molten aluminum 6 gradually rises in each cavity 9*c* as it is sequentially charged into the slots 1*b* in the order of arrangement from the slot nearest to the corresponding gate 9*b*. In this manner, the molten aluminum 6 reaches the side of the upper end ring portion that is nearest to the gate 9*b* and, then, the gas discharge channel 41. After the molten aluminum 6 has been completely charged, a high pressure of about 400 kg/cm$^2$ is applied to the aluminum 6 in a molten or semi-molten state thereof for solidifying purposes. Then, the top die 11 and the bottom die 9 are separated from each other so that the rotary cores 1 each having the rotor conductor are extruded by means of the extrusion rods 5.

FIGS. 6A and 6B are a cross-sectional view and a side view, respectively, showing an example of the squirrel-cage rotor produced by the above-described liquid metal forging process. As shown in FIG. 6A, in the squeeze casting process, since molten aluminum is charged at a reduced flow velocity, the amount of air or gas which may enter the charged conductive material 6 can be reduced. Furthermore, since the high pressure is maintained until solidification is completed, it is possible to produce an electrical conductor of high density free from shrinkage cavities.

FIG. 7 is a characteristic chart showing the torque characteristics and the efficiency of a squirrel-cage rotor having an aluminum density of 2.67 g/cm$^3$, produced by the aforesaid squeeze casting process, in comparison with those of a die-cast product having an aluminum density of 2.57 g/cm$^3$. The vertical axis represents torque (kg·cm) and efficiency (%), while the horizontal axis represents the speed of revolutions (rpm). In FIG. 7, a curve A represents the torque characteristic curve of the squeeze casting product, a curve B the torque characteristic curve of the die-cast product, a curve C the efficiency characteristic curve of the squeeze casting product, and a curve D the efficiency characteristic curve of the die-cast product. As can be seen from FIG. 7, when compared to the die-cast product, the squeeze casting product having a high aluminum density achieves great improvements in torque characteristics and efficiency of the motor.

As is apparent from the foregoing, the squeeze casting process makes it possible to improve the motor characteristics compared to the die-casting process. Accordingly, a rotor which can satisfactorily utilize the material characteristics of the rotor conductor can be designed using critical values and it is possible to reduce the size and weight of the motor and also to achieve material savings or cost savings.

However, the aforesaid squeeze casting process still has a number of problems. For example, if the cross-sectional area of each end ring portion is relatively small compared to that of each slot, solidification in the slots will occur before it occurs in the top end ring portion during the step of charging the molten aluminum into the bottom end ring portion, the slots and the top end ring portion in that order and solidifying it in sequence. During this step, pressure is likewise applied to the bottom end ring portion, the slots and the top end ring portion in that order. However, if the molten aluminum in the slots solidify prior to that the top end ring portion, the pressure is not transmitted to the top end ring portion. Accordingly, high pressure cannot be applied to the top end ring portion until the solidification is completed, with the result that shrinkage cavities are formed. Also, if the cross-sectional area of each gate is small compared to that of the bottom end ring portion, similar shrinkage cavities are formed in the bottom end ring portion. In general, it is preferred that the cross sectional area of each gate be made small so that the material solidified in the gates can be cut only by a die-opening action.

As is apparent from the foregoing, in the conventional die-casting process, shrinkage cavities are formed in the entire rotor conductor of the squirrel-cage rotor. On the other hand, in the squeeze casting process, molten conductive material nonuniformly solidifies and, for instance, if solidification in the slots occurs prior to that in the upper end ring portion, shrinkage cavities will be formed in the upper end portion. The result is a decrease in electrical conduction which may adversely influence the torque or efficiency of the motor.

SUMMARY OF THE INVENTION

It is therefore a primary object of the present invention to solve the conventional problems described above.

It is another object of the present invention to provide a squirrel-cage rotor provided with a solid rotor conductor free from shrinkage cavities.

It is another object of the present invention to provide a method of manufacturing such a squirrel-cage rotor by applying high pressure to the entire molten conductive material, which forms slot conductors and end rings, until solidification is completed.

It is another object of the present invention to provide a squirrel-cage rotor which enables improvements in the efficiency and the torque characteristics of a motor and reductions in the size and the weight of the same.

It is another object of the present invention to provide a defect-free, high-definition cast product of the type suitable for use as VTR drums or the like having no shrinkage cavities.

In order to achieve the above objects, according to one aspect of the present invention, there is provided a method of manufacturing a defect-free cast product comprising the steps of forming a cavity surrounded by a plurality of dies, charging molten conductive material into the cavity, applying pressure to the conductive material by pressure means, and selectively applying additional pressure to the portion of the conductive material which may suffer shrinkage cavities due to delay in solidification, by utilizing the pressure applied by the pressure means and by relatively moving a portion of the dies with respect to the conductive material when the conductive material solidifies and shrinks, whereby pressure is applied to the entire cast product to prevent occurrence of the shrinkage cavities.

According to another aspect of the present invention, there is provided a method of manufacturing a squirrel-cage rotor comprising the steps of forming a cavity by arranging a plurality of dies around a rotor core, charging molten conductive material into the cavity, applying pressure to the conductive material by pressure means, and selectively applying additional pressure to the portion of the conductive material which may suffer shrinkage cavities due to delay in solidification, by utilizing the pressure applied by the pressure means, thereby forming a slot conductor and end rings connected thereto and disposed on opposite end faces of the rotor core.

Further objects, features and advantages of the present invention will become apparent from the following detailed description of embodiments of the present invention with reference to the accompanying drawings.

DESCRIPTION OF THE PREFERRED EMBODIMENTS

Defect-free cast products and manufacturing methods therefor according to embodiments of the present invention will be explained below with reference to the accompanying drawings.

The embodiments 1 to 4 shown in FIGS. 8–11 and the embodiments shown in 8–17 shown in FIGS. 15–27 will be explained with illustrative reference to a squirrel-cage rotor, while the embodiments shown in FIGS. 12–14 will be explained with illustrative reference to a VTR drum.

EMBODIMENT 1

Figure 8:
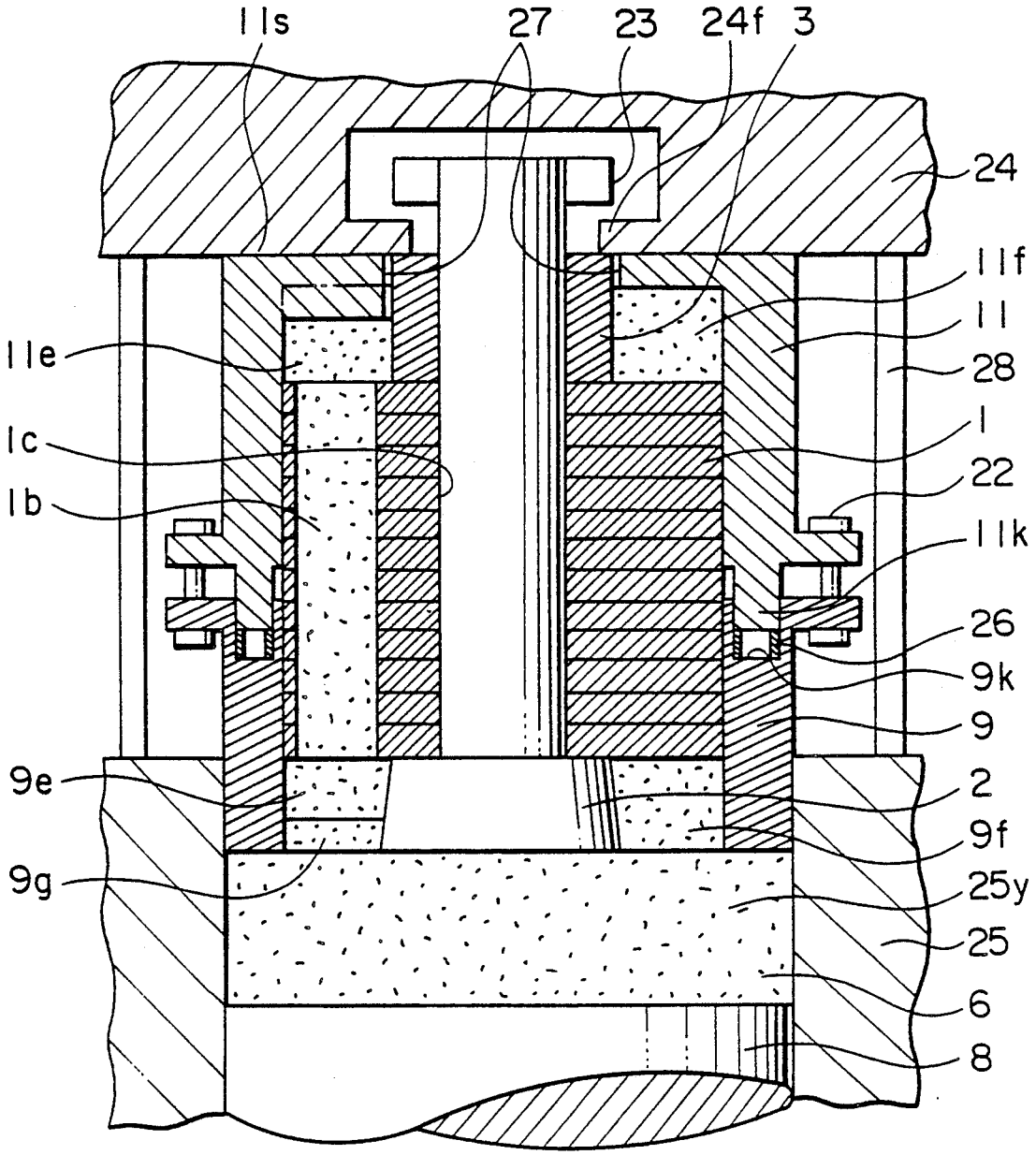
FIGS. 8–11 are cross-sectional views, respectively, showing manufacturing apparatus for squirrel-cage rotors according to first to fourth embodiments of the present invention.

FIG. 8 is a cross-sectional view showing a manufacturing apparatus for squirrel-cage rotors according to Embodiment 1 of the present invention, and the right-hand half and left-hand half show cut surfaces taken at different angles with respect to the axis of the apparatus, respectively.

In FIG. 8 et seq. which will be hereinafter referred to, like reference numerals are used to denote the like or corresponding elements used in the above-described conventional manufacturing apparatus.

In the manufacturing process according to Embodiment 1, a temporary holding shaft 2 is inserted through a bottom die 9 from below and a rotor core 1 is then fitted onto the temporary holding shaft 2. Further, a collar 3 is fitted onto the shaft 2 so that the rotor core 1 is secured in position by fastening. Then, a movement absorbing part 26, such as an aluminum ring or the like, is secured in a bottom-die joint recess **9*k*, the movement absorbing part 26 having dimensional accuracy which allows for product dimensions and the amount of shrinkage due to solidification. Then, a top die 11 is mounted into mating engagement with the bottom die 9 and fastening metals 22 are used to join the top die 11 and the bottom die 9 by an appropriate magnitude of fastening force. The movement absorbing part 26 has the function of absorbing the movement of the bottom die 9 during solidification under pressure. Then, a suspending ring 23 is fitted onto one end of the temporary holding shaft 2, and the temporary holding shaft 2 is suspended with the suspending ring 23 held by a hook 24*f* of a platen 24. Then, after a molten conductive material 6, such as molten aluminum, has been poured into a liquid metal reservoir 25*y* in a predetermined amount, the platen 24 is moved down to insert the bottom die 9 into the liquid metal reservoir 25*y* down to a predetermined position. At this position, the platen 24 applies a predetermined level of pressure to a bottom platen 25 by means of a clamping ring 28. Thereafter, the molten conductive material 6 is pressed by a pressure plunger 8** from below.

In the above step, the molten conductive material 6 is forced into a top end ring portion **11*e* through a gate 9*g*, a bottom fin 9*f*, a bottom end ring portion 9*e* and a slot 1*b*. It is preferable that the flow velocity during this time be made comparatively small (20,000 or less in Reynolds number) in order to prevent an excessive amount of air or gas from entering the molten conductive material 6**.

After a major part of air or gas in the dies and slots has been discharged through gas discharge channels 27 and the molten conductive material 6 has reached the gas discharge channels 27, the portion of the material 6 at or near the gas discharge channels 27 is quenched and solidified.

At this point in time, force which acts to press the top die 11 upward starts working, whereby a high pressure of 400 kg/cm$^2$ or more is applied to a top end **11*s* of the top die 11 and the product through the liquid metal reservoir 25*y* and the gate 9*g*. In this step, since the cross-sectional area of each slot 1*b* is selected to be small, solidification initially occurs in the slots 1*b*, and the rotor core 1, the temporary holding shaft 2 and the bottom die 9 are moved axially in the upward direction due to the differential pressure between the opposite ends of the rotor core 1 or the differential pressure between the lower surface of the bottom die 9 and the upper end face of the rotor core 1 (if solidification initially occurs in the gate 9***g*). Accordingly, a high pressure of 400 kg/cm$^2$ is likewise applied to the top end ring portion 11*e*. At this time, the amount of shrinkage of the top end ring portion 11*e* due to solidification is approximately 6.6% in terms of pure aluminum, that is, if the top end ring portion 11*e* has a thickness of approximately 20 mm, the amount of shrinkage thereof is 1.32 mm. By the above application of pressure, the movement absorbing part 26 is compressed by approximately 1.32 mm. Further, only the bottom die 9 is moved up due to the differential pressure between the lower surface of the bottom die 9 and the lower face of the bottom end ring portion 9*e*, thereby applying pressure to the bottom end ring portion 9*e*. When the bottom end ring portion 9*e* solidifies under pressure, the movement absorbing part 26 is compressed by approximately 1.32 mm. Accordingly, merely by solidifying either of the two end ring portions 9*e* and 11*e* subsequently to the slots 1*b*, it is possible to apply pressure to the entire cast product, thereby realizing a defect-free cast product having no shrinkage cavities.

EMBODIMENT 2

Figure 9:
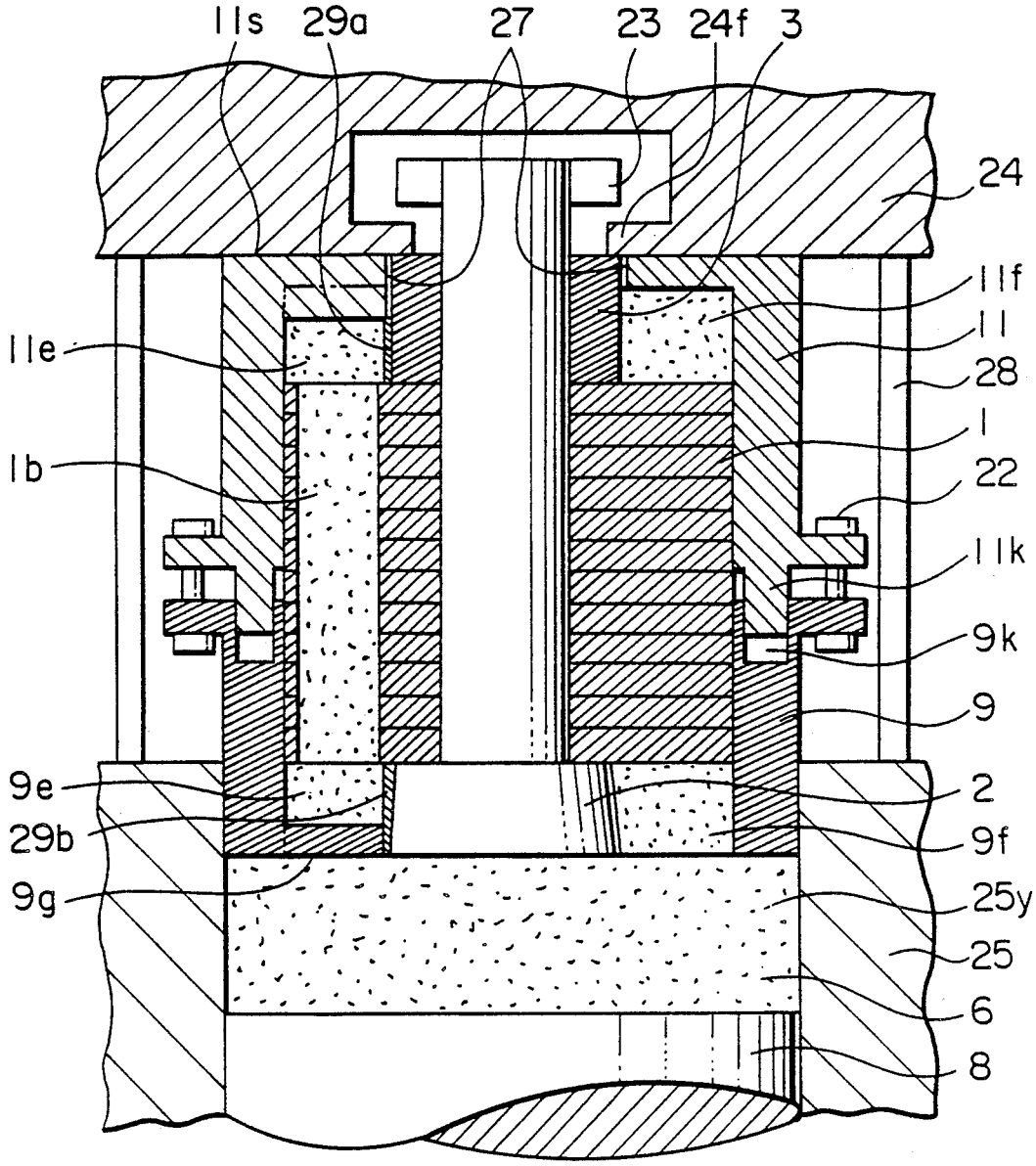

FIG. 9 is a cross-sectional view showing a manufacturing apparatus for squirrel-cage rotors according to Embodiment 2 of the present invention, and the right-hand half and left-hand half show cut surfaces taken at different angles with respect to the axis of the apparatus, respectively.

The construction and operation of Embodiment 2 is substantially the same as those of Embodiment 1, except that a part made of the same material as a cast product is provided on a moving part of the cast product so that the relative movement between the cast product and the dies can be absorbed in themselves. With Embodiment 2, it is possible to manufacture defect-free cast products having no shrinkage cavities without the need to collect a movement absorbing part 29*a* or 29*b*. More specifically, the movement absorbing part 29*a* set in the top end ring portion 11*e* compensates for the amount of shrinkage of the top end ring portion 11*e* due to solidification, while the movement absorbing part 29*b* set in the bottom end ring portion 9*e* compensates for the amount of shrinkage of the bottom end ring portion 11*e* due to solidification. Since the movement absorbing parts 29*a* and 29*b* are made of the same material as the cast product, they do not adversely influence the cast product after fused therewith. In addition, it is not necessary to take out the movement absorbing parts 29*a* and 29*b* after the product has been finished.

EMBODIMENT 3

Figure 10:
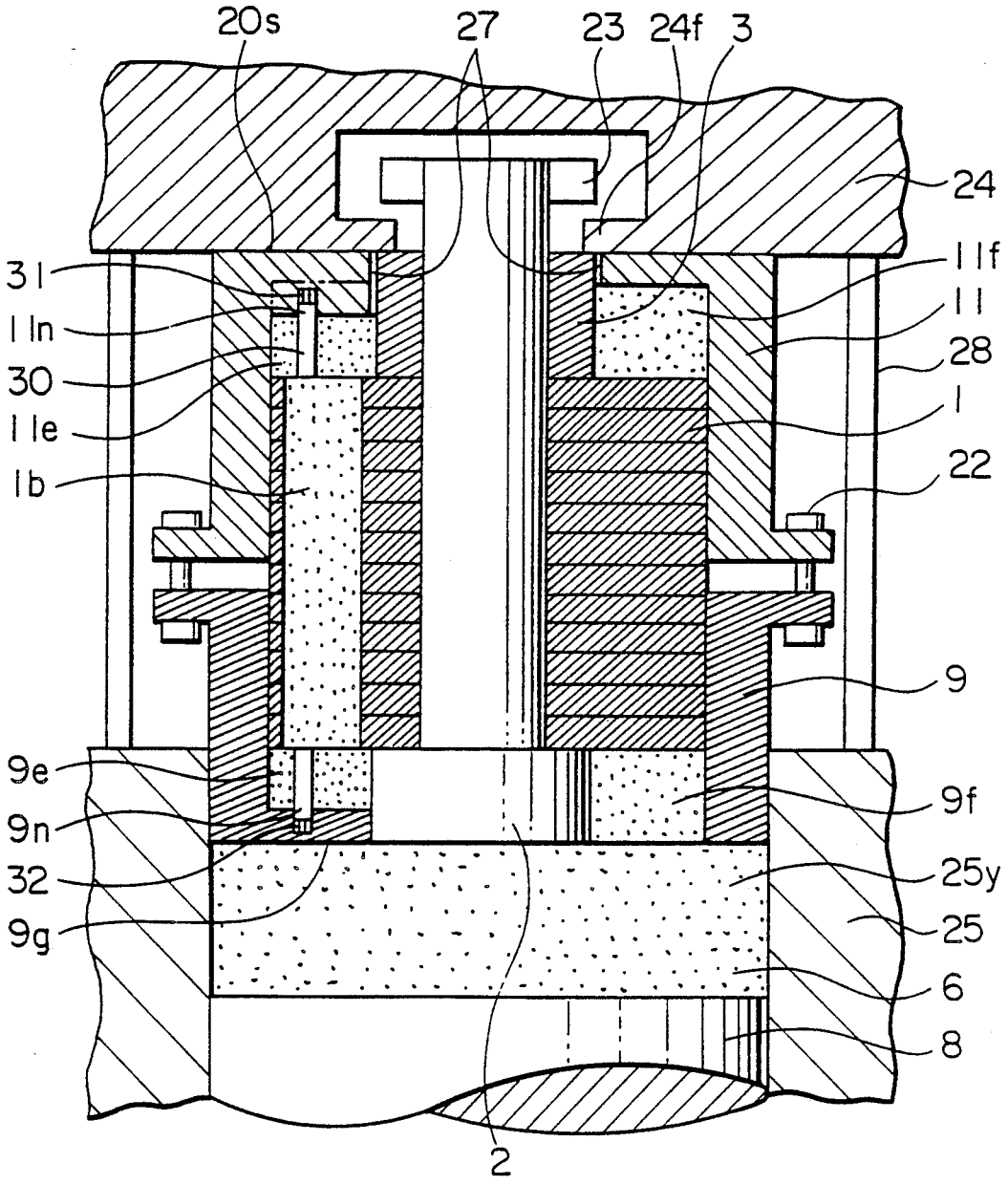

FIG. 10 is a cross-sectional view showing a manufacturing apparatus for double squirrel-cage rotors according to Embodiment 3 of the present invention, and the right-hand half and left-hand half show cut surfaces taken at different angles with respect to the axis of the apparatus, respectively.

In the illustrated apparatus, a top-die movement absorbing part 31 is disposed between a core 30 and the top die 11, while a bottom-die movement absorbing part 32 is disposed between the core 30 and the bottom die 9. An engagement recess for engaging the core 30 with the top die 11 is denoted by 11*n*, while an engagement recess for engaging the core 30 with the bottom die 9 is denoted by 9*n*. In the double squirrel-cage rotor according to Embodiment 3, the portion of each end ring portion defined between fins is divided into sections and it is therefore necessary to provide the core 30 in that portion. Accordingly, it is impossible to apply the process used in Embodiment 1 to the manufacturing of such a squirrel-cage rotor. For this reason, the respective movement absorbing parts 31 and 32 are disposed between the core 30 and the top and bottom dies 11 and 9.

In the manufacturing process according to Embodiment 3, the top-die and bottom-die movement absorbing parts 31 and 32, such as aluminum rings or the like, are secured in the engagement recesses 11*n* and 9*n* formed in the top die 11 and the bottom die 9, respectively, and the core 30 is disposed between the engagement recesses 11*n* and 9*n*. Each of the movement absorbing part 31 and 32 has dimensional accuracy which allows for product dimensions and the amount of shrinkage due to solidification. Then, the rotor core 1 is fitted onto the temporary holding shaft 2, fixed in position by means of the collar 3, and then fitted into the bottom die 9 prepared previously. Then, the top die 11 is fitted onto the rotor core 1 from above and the fastening metal 22 are used to join the top die 11 and the bottom die 9 by an appropriate magnitude of fastening force. Then, the suspending ring 23 is fitted onto one end of the temporary holding shaft 2, and the temporary holding shaft 2 is suspended with the suspending ring 23 held by the hook 24*f* of the platen 24. Then, after the molten conductive material 6, such as molten aluminum, has been poured into the liquid metal reservoir 25*y* in a predetermined amount, the platen 24 is moved down to insert the bottom die 9 into the liquid metal reservoir 25*y* down to a predetermined position. At this position, the platen 24 applies a predetermined level of pressure to the bottom platen 25 by means of the clamping ring 28. Thereafter, the molten conductive material 6 is pressed from below by the pressure plunger 8.

As in the case of Embodiment 1, after a major part of air or gas in the dies and slots has been discharged through the gas discharge channels 27 and the molten conductive material 6 has reached the gas discharge channels 27, the portion of the material 6 at or near the gas discharge channels 27 is quenched and solidified.

At this point in time, force which acts to press the top die 11 upward starts working, whereby a high pressure of 400 kg/cm$^2$ or more is applied to the top end 11*s* of the top die 11 and the product through the liquid metal reservoir 25*y* and the gate 9*g*. In this step, since the cross-sectional area of each slot 1*b* is selected to be small, solidification initially occurs in the slots 1*b* and the rotor core 1, the temporary holding shaft 2 and the bottom die 9 are moved axially in the upward direction due to the differential pressure between the opposite ends of the rotor core 1 or the differential pressure between the lower surface of the bottom die 9 and the upper end face of the rotor core 1 (if solidification initially occurs in the gate 9*g*). Accordingly, a high pressure of 400 kg/cm$^2$ is likewise applied to the top end ring portion 11*e*. At this time, the amount of shrinkage of the top end ring portion 11*e* due to solidification is approximately 6.6% in terms of pure aluminum, that is, if the top end ring portion 11*e* has a thickness of approximately 20 mm, the amount of shrinkage thereof is 1.32 mm. By the above application of pressure, the top-die movement absorbing part 31 is compressed by approximately 1.32 mm. Further, only the bottom die 9 is moved up due to the differential pressure between the lower surface of the bottom die 9 and the lower face of the bottom end ring portion 9*e*, thereby applying pressure to the bottom end ring portion 9*e*. When the bottom end ring portion 9*e* solidifies under pressure, the bottom-die movement absorbing part 32 is compressed by approximately 1.32 mm. Accordingly, merely by solidifying either of the two end ring portions 9*e* and 11*e* subsequently to the slots 1*b*, it is possible to apply pressure to the entire cast product, thereby realizing a defect-free cast product having no shrinkage cavities.

EMBODIMENT 4

Figure 11:
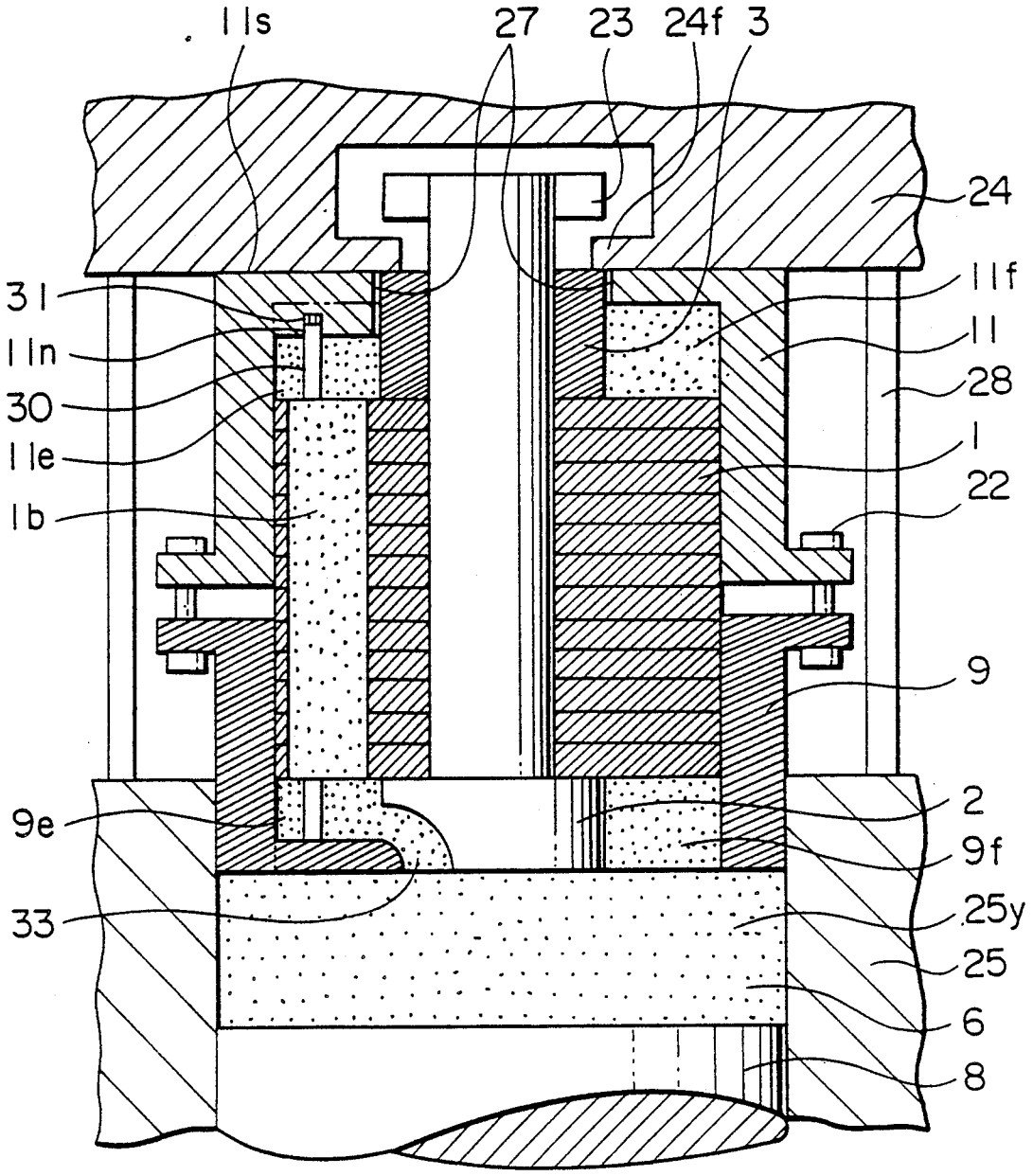

FIG. 11 is a cross-sectional view showing a manufacturing apparatus for double squirrel-cage rotors according to Embodiment 4 of the present invention, and the right-hand half and left-hand half show cut surfaces taken at different angles with respect to the axis of the apparatus, respectively.

In the double squirrel-cage rotor according to Embodiment 4, the top-die movement absorbing part 31 is disposed between the core 30 and the top die 11*e*, while the bottom die 9*e* is provided with an inward gate 33 capable of achieving directional solidification which starts from an upper portion thereof, as practiced in general squeeze casting processes.

In the manufacturing process according to Embodiment 4, the top-die movement absorbing parts 31, such as aluminum rings or the like, is secured in the engagement recess 11*n* formed in the top die 11, and one end of the core 30 is fitted into the engagement recess 11*n*. The top-die movement absorbing part 31 has dimensional accuracy which allows for product dimensions and the amount of shrinkage due to solidification. Then, the rotor core 1 is fitted onto the temporary holding shaft 2 from above, fixed in position by means of the collar 3, and then fitted into the bottom die 9. Then, the top die 11 prepared previously is fitted onto the rotor core 1 from above and the fastening metals 22 are used to join the top die 11 and the bottom die 9 by an suspending ring 23 is fitted onto one end of the temporary holding shaft 2, and the temporary holding shaft 2 is suspended with the suspending ring 23 held by the hook 24*f* of the platen 24. Then, after the molten conductive material 6, such as molten aluminum, has been poured into the liquid metal reservoir 25*y* in a predetermined amount, the platen 24 is moved down to insert the bottom die 9 into the liquid metal reservoir 25*y* down to a predetermined position. At this position, the platen 24 applies a predetermined level of pressure to the bottom platen 25 by means of the clamping ring 28. Thereafter, the molten conductive material 6 is pressed from below by the pressure plunger 8.

As in the case of Embodiment 1, after a major part of air or gas in the dies and slots has been discharged through the gas discharge channels 27 and the molten conductive material 6 has reached the gas discharge channels 27, the portion of the material 6 at or near the gas discharge channels 27 is quenched and solidified.

At this point in time, force which acts to press the top die 11 upward starts working, whereby a high pressure of 400 kg/cm$^2$ or more is applied to the top end 11*s* of the top die 11 and the product through the liquid metal reservoir 25*y* and the gate 9*g*. In this step, since the cross-sectional area of each slot 1*b* is selected to be small, solidification initially occurs in the slots 1*b*, and the rotor core 1, the temporary holding shaft 2 and the bottom die 9 are moved axially in the upward direction due to the differential pressure between the opposite ends of the rotor core 1 or the differential pressure between the lower surface of the bottom die 9 and the upper end face of the rotor core 1. Accordingly, a high pressure of 400 kg/cm$^2$ is likewise applied to the top end ring portion 11*e*. At this time, the amount of shrinkage of the top end ring portion 11*e* due to solidification is approximately 6.6% in terms of pure aluminum, that is, if the top end ring portion 11*e* has a thickness of approximately 20 mm, the amount of shrinkage thereof is 1.32 mm. Accordingly, by the above application of pressure, the movement absorbing part 26 is compressed by approximately 1.32 mm. Further, since the bottom die 9*e* is provided with the inward gate 33 capable of achieving directional solidification which starts from an upper portion thereof, as practiced in general squeeze casting processes, it is possible to apply pressure to the entire cast product, thereby realizing a defect-free cast product having no shrinkage cavities.

EMBODIMENT 5

Figure 12:
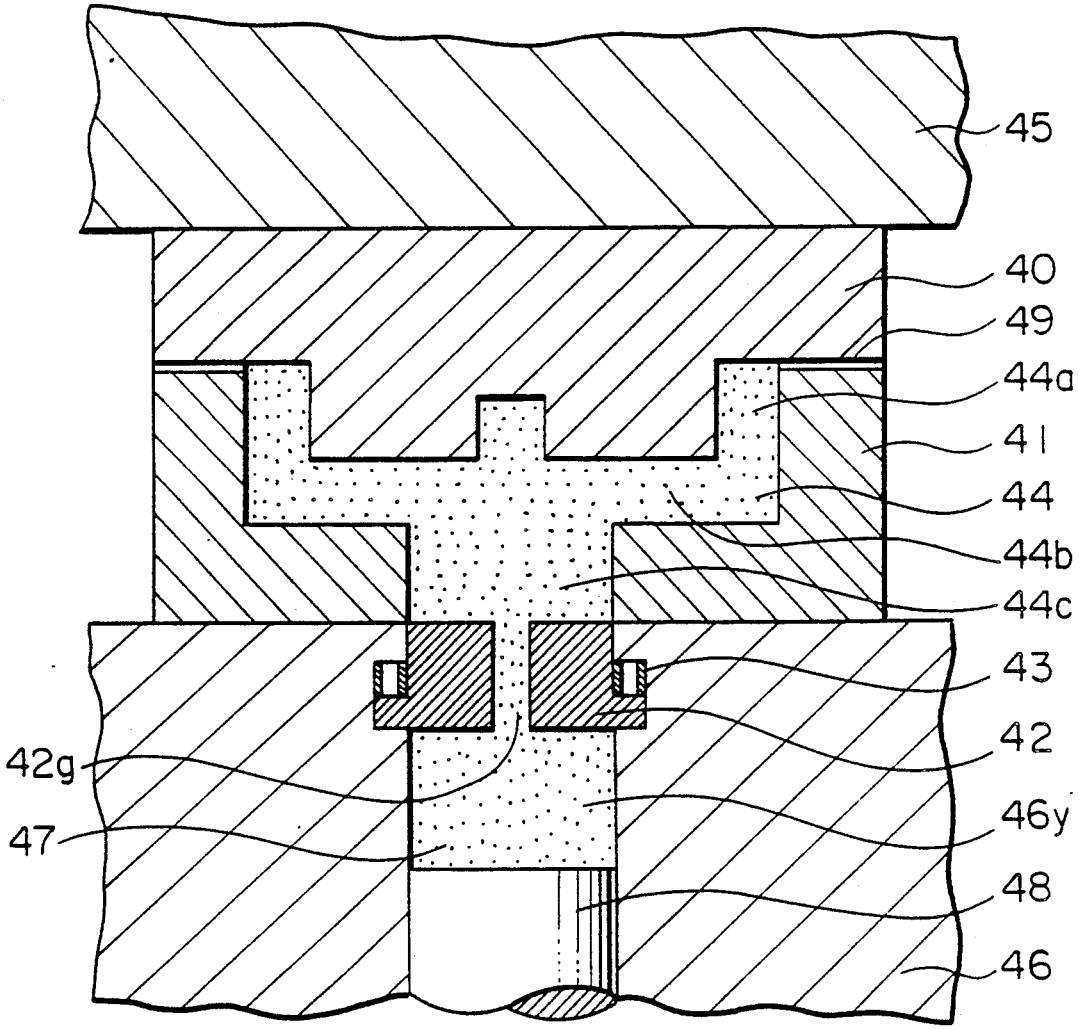
FIGS. 12–14 are cross-sectional views, respectively, showing manufacturing apparatus for VTR drums according to fifth to seventh embodiments of the present invention.

FIG. 12 is a cross-sectional view showing a manufacturing apparatus for VTR drums according to Embodiment 5 of the present invention.

In the manufacturing process according to Embodiment 5, after a molten metal 47, such as molten aluminum, has been poured into a liquid metal reservoir 46*y* in a predetermined amount, a bottom die 42 is set in a bottom platen 46 by means of a bottom-die movement absorbing part 43 such as an aluminum ring or the like. The bottom-die movement absorbing part 26 has dimensional accuracy which allows for product dimensions and the amount of shrinkage due to solidification. Then, the top platen 45 is moved down to clamp the top die 40 and an intermediate die 41 and, in the clamped state, a pressure plunger 48 is move up to apply pressure to the molten metal 47.

After a major part of air or gas in the dies and slots has been discharged through gas discharge channels 49 and the molten metal 47 has reached the gas discharge channels 49, the portion of the molten metal 47 at or near the gas discharge channels 49 is quenched and solidified.

At this point in time, the molten metal 47 in a gate 42*g* which is intentionally made narrow starts rapidly solidifying. As a result, a differential pressure occurs between the opposite ends of the bottom die 42 to generate force which acts to press the bottom die 42 upward, whereby the interior of a cavity 44 is subjected to a high pressure of 400 kg/cm$^2$ or more through the bottom die 42. At this time, the amount of shrinkage due to solidification in the cavity 44 is approximately 6.6% in terms of pure aluminum. Therefore, the bottom die 42 moves up in a corresponding amount, while the bottom-die movement absorbing part 43 is compressed by the above application of pressure. Accordingly, by forming in the bottom die 42 a gate in which solidification necessarily occurs earliest, it is possible to apply pressure to the entire cast product, thereby realizing a defect-free cast product having no shrinkage cavities. Another advantage of the above process is that, since the gate is narrow, it can be easily cut when the finished product is taken out, whereby the quality of products can be improved.

EMBODIMENT 6

Figure 13:
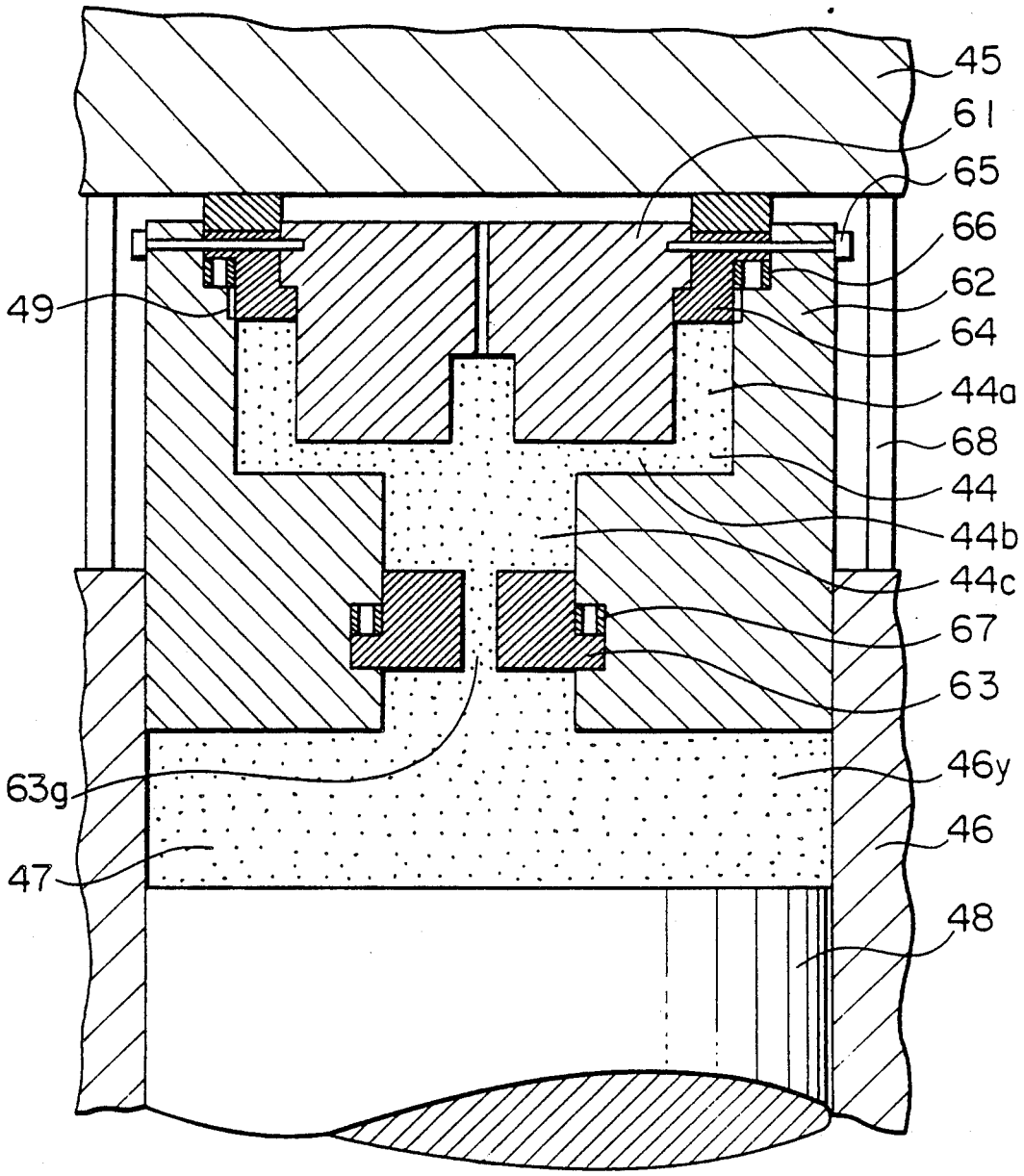

FIG. 13 is a cross-sectional view showing an manufacturing apparatus for VTR drums according to Embodiment 6 of the present invention.

In the manufacturing process according to Embodiment 6, a first die 61, which is hooked by a fourth die 64, is secured to the top platen 45. Then, a second die 62 to which a third die 63 is secured via a second die-movement absorbing part 67, is secured by a pin 65 to the first die 61 and the fourth die 64 via a first die-movement absorbing part 66 having dimensional accuracy which allows for product dimensions and the amount of shrinkage due to solidification. Then, after the molten metal 47, such as molten aluminum, has been poured into the liquid metal reservoir 46*y* in a predetermined amount, the top platen 45 is moved down to insert the second die 62 into the liquid metal reservoir 46*y* down to a predetermined position. At this position, the top platen 45 applies a predetermined level of pressure to the bottom platen 46 by means of a clamping ring 68 and is then pressed from below by the pressure plunger 48.

After a major part of air or gas in the dies and slots has been discharged through the gas discharge channels 49 and the molten metal 47 has reached the gas discharge channels 49, the portion of the molten metal 47 at or near the gas discharge channels 49 is quenched and solidified.

At this point in time, the molten metal 47 in a gate 63*g* which is intentionally made narrow starts rapidly solidifying. As a result, a differential pressure occurs between the opposite ends of the third die 63 to generate force which acts to press the third die 63 upward, whereby the interior of the cavity 44 is subjected to a high pressure of 400 kg/cm$^2$ or more through the third die 63. In Embodiment 6, since a second cavity portion 44*b* is narrower than a first cavity portion 44*a*, solidification starts first in the gate 63*g* and then in the second cavity portion 44*b*. As a result, a differential pressure occurs between the top and bottom of the solidified portion to generate force which acts to pres the first and second dies 61 and 62 in the upward direction, whereby pressure is applied to the molten metal in the first cavity portion 44*a*. The amount of shrinkage resulting from solidification at that time is absorbed by the first die-movement absorbing part 66. Thereafter, the molten metal in a third cavity portion 44*c* solidifies and, the amount of shrinkage due to solidification therein is absorbed by the second die-movement absorbing part 67. Since the amount of shrinkage due to solidification is approximately 6.6% in terms of pure aluminum, the dies may be designed by taking account of corresponding dimensions.

As is apparent from the foregoing, even in the case of complicated cast products having a plurality of directional solidification areas, it is possible to apply pressure to the entire cast product by providing a plurality of movable parts, whereby a defect-free cast product having no shrinkage cavities is produced.

EMBODIMENT 7

Figure 14:
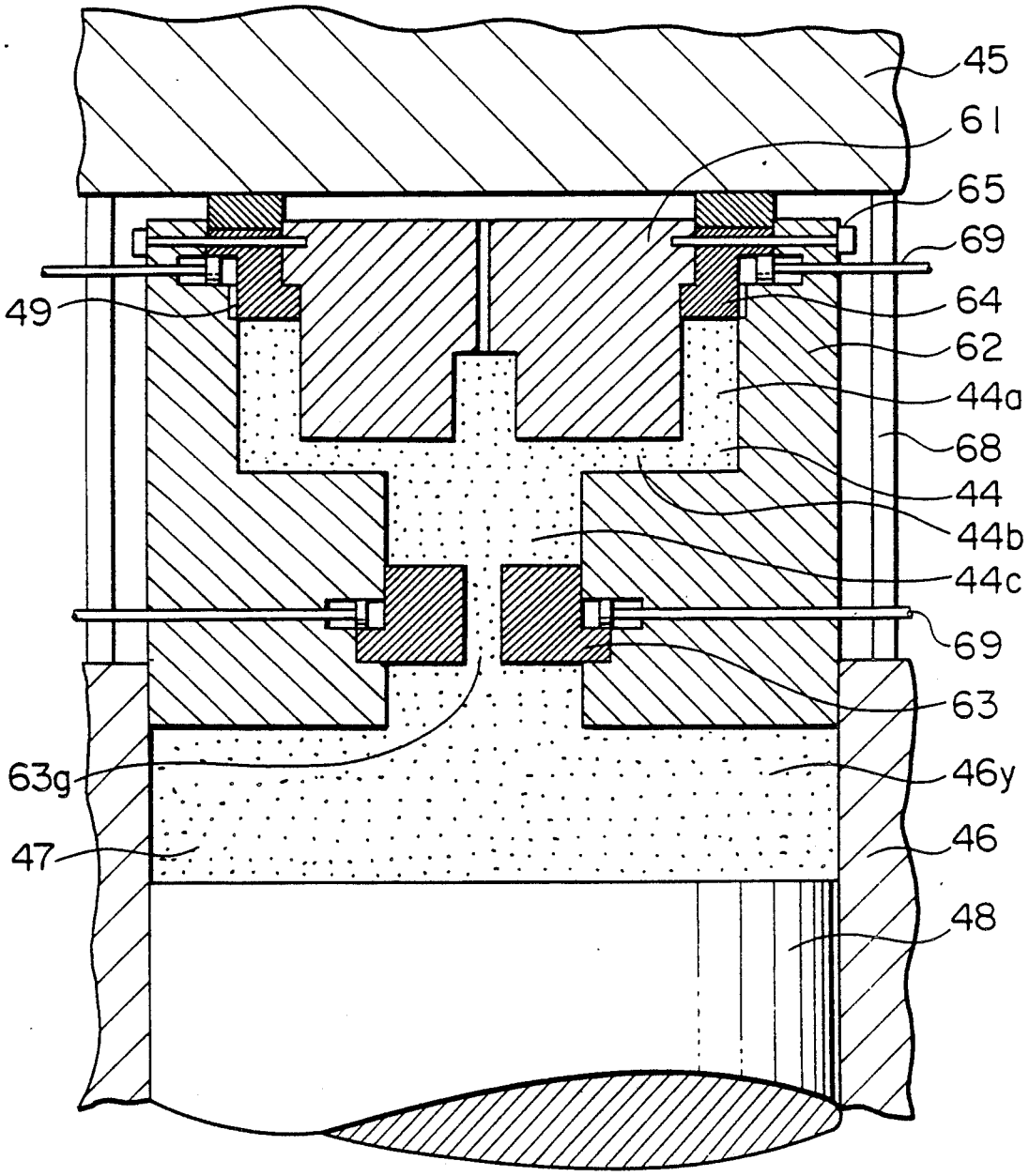

FIG. 14 is a cross-sectional view showing a manufacturing apparatus for VTR drums according to Embodiment 7 of the present invention.

The apparatus according to Embodiment 7 is basically the same as that of Embodiment 6 shown in FIG. 13, except that mechanical movement mechanisms employing hydraulic pressure or the like are used as movement absorbing parts 69. Advantages similar to those of Embodiment 6 are achieved by a method of withdrawing such mechanisms at the instant when the molten metal 47 is completely charged. In this embodiment, such movable parts may be operated directly by hydraulic pressure.

Although Embodiment 7 employs an aluminum ring or a hydraulic mechanical movement mechanism as the movement absorbing parts 69, it is of course possible to utilize friction due to mating engagement, a spring or any other means that does not move until molten metal is charged and yet that can be easily moved by a pressure of 400 kg/cm$^2$ or more.

In addition, the present invention is applicable to a spindle motor hub for a floppy disk drive or any other kind of cast product produced by a die-casting process, a squeeze casting process or the like.

EMBODIMENT 8

Figure 15:
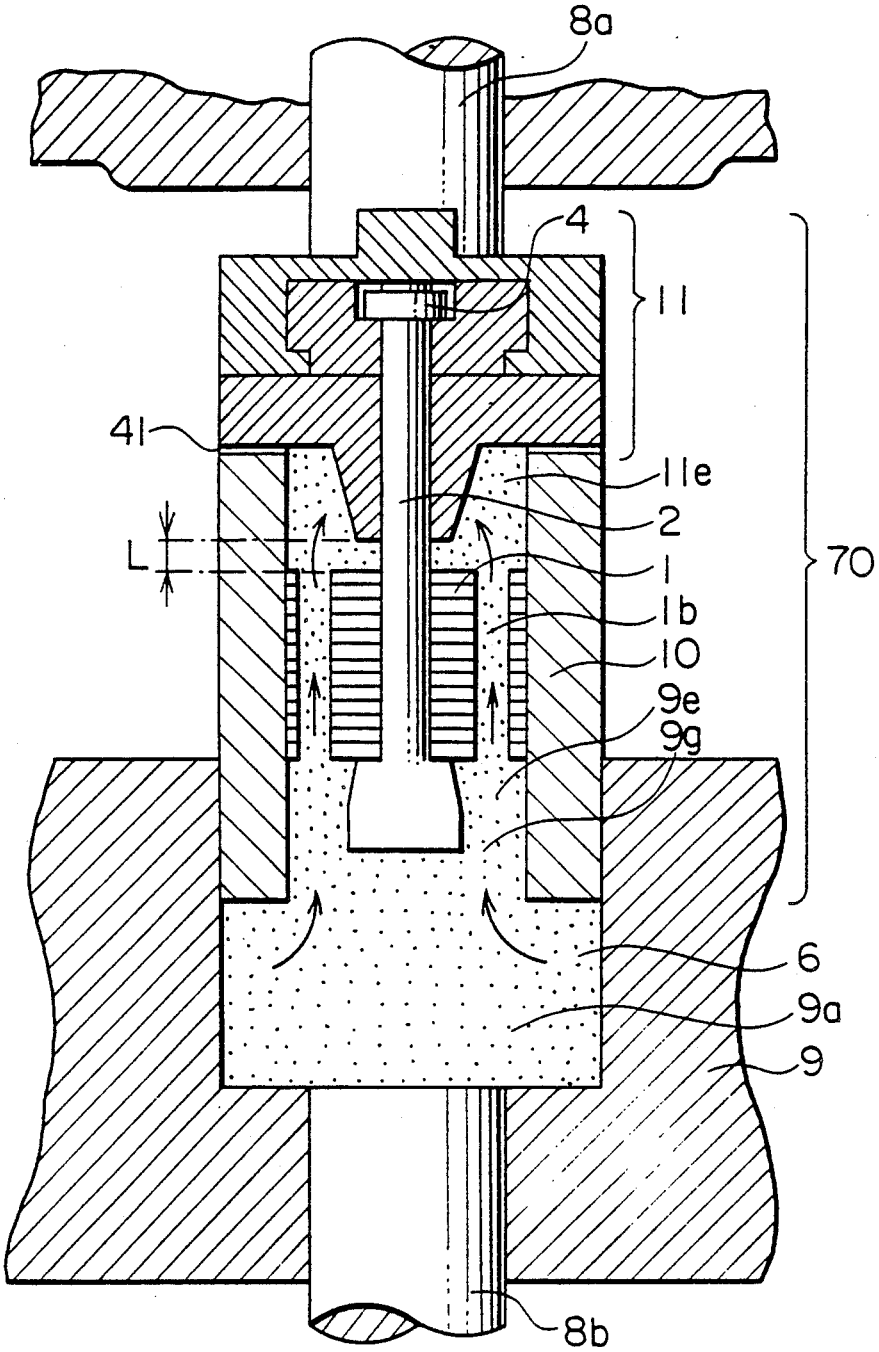
FIGS. 15–17 are cross-sectional views, respectively, showing manufacturing apparatus for squirrel-cage rotors according to an eighth embodiment of the present invention.

FIG. 15 is a cross-sectional view showing a manufacturing apparatus for squirrel-cage rotors according to Embodiment 8 of the present invention. In the illustrated apparatus, the top end ring portion 11*e* is formed by the top die 11 and the intermediate die 10 immediately below the bottom of the top die 11. The intermediate die 10 defines a flow passage for the molten conductive material 6 and serves as a heat insulation wall for the rotor core 1. The intermediate die 10 is also provided with the bottom end ring portion 9*e* and the gate 9*g* for introducing into the intermediate die 10 the molten conductive material 6 accommodated in the liquid metal reservoir 9*a* formed in the bottom die 9. Gas discharge channels 41 provide communication between the top end ring portion 11*e* and the exterior so as to discharge air or gas from the cavity of the dies. The temporary holding shaft 2 for holding the rotor core 1 has the function of holding the rotor core 1 in a predetermined position within the dies by means of friction resulting from engagement between the temporary holding shaft 2 and the rotor core 1 until the molten conductive material 6 is completely charged. The temporary shaft 2 is secured to the top die 11 by the nut 4. The bottom end of the temporary holding shaft 2 forms the inner peripheral wall of the bottom end ring portion 9*e*. A top pressure plunger 8*a* serves to suspend a top movable die assembly 70 which includes the top die 11, the temporary holding shaft 2, the nut 4, the rotor core 1 and the intermediate die 10. When the top pressure plunger 8*a* is moved down, it is inserted into the bottom die 9 to apply pressure to the molten conductive material 6 therein. When the top pressure plunger 8*a* is moved up, it is retracted from the bottom die 9. A bottom pressure plunger 8*b*, as illustrated, normally forms a part of the bottom of the liquid metal reservoir 9*a* and serves to apply pressure to the molten conductive material 6 and to extrude the product. Each arrow indicates the flow of the molten conductive material 6.

The top of the rotor core 1 and the bottom of the to die 11 are spaced apart from each other by a pressure margin L which allows the rotor core to move axially in the upward direction to apply pressure to the top end ring portion 11*e*. The size of the pressure margin L is determined by calculating the amount of volumetric reduction resulting from the solidification of the molten conductive material 6 charged in the top end ring portion 11*e* (a phase transition from liquid phase to solid phase).

In the manufacturing method according to Embodiment 8, the rotor core 1 is fitted onto the temporary holding shaft 2, which is in turn inserted into an opening formed in the top die 11 and secured thereto with the nut 4. Then, the rotor core 1 is fitted into the intermediate die 10, and the dies thus assembled, which constitute the top movable dies 70, are secured to the top pressure plunger 8*a*. Then, a predetermined amount of molten conductive material 6, such as molten aluminum, is poured into the liquid metal reservoir 9*a* formed in the preheated bottom die 9. Subsequently, the top pressure plunger 8*a* is moved down to insert the top movable dies 70 into the liquid metal reservoir 9*a*, thereby applying pressure to the molten conductive material 6.

In the above step, the molten conductive material 6 is forced into the top end ring portion 11*e* through the gate 9*g*, the bottom end ring portion 9*e* and the slots 1*b*. It is preferable that the flow velocity of the molten conductive material 6 be made comparatively small (20,000 or less in Reynolds number) in order to prevent an excessive amount of air or gas from entering the molten conductive material 6.

After a major part of air or gas in the dies and slots has been discharged through the gas discharge channels 41 and the molten conductive material 6 has reached the gas discharge channels 41, the portion of the material 6 at or near the gas discharge channels 41 is quenched and solidified.

At this point in time, the pressure applied by the top pressure plunger 8*a* starts to rapidly rise, whereby a high pressure of 400 kg/cm$^2$ or more is applied to the product through the liquid metal reservoir 9*a* and the gate 9*g*. In this step, the rotor core 1 is moved axially in the upward direction due to a differential pressure between the opposite ends of the rotor core 1 which is generated from the solidification of the molten conductive material 6 charged in the slots 1*b*, that is, due to pressure acting on the bottom of the rotor core 1. A high pressure of 400 kg/cm$^2$ is likewise applied to the top end ring portion 11*e*.

For instance, when twenty-six slot conductors and each end ring 6.0 cm$^2$ in cross-sectional area and 20 mm in height are to be formed by pouring the molten aluminum 6 into the rotor core 1 having a diameter of 43 mm, a length of 55 mm and twenty-six slots 1*b* each having a cross-sectional area of 0.16 cm$^2$, the top movable dies 70 and the bottom die 9 are preheated to temperatures of 400° C. and 250° C., respectively, and molten aluminum heated to a temperature of 760° C. is poured into the liquid metal reservoir 9*a* as the molten conductive material 6. Then, the top pressure plunger 8*a* is moved down into the liquid metal reservoir 9*a* at a speed of 6 mm/sec, thereby applying a pressure of 500 kg/cm$^2$ for the purpose of solidifying the molten aluminum. The flow velocity of molten aluminum is selected to be 10,000 or less in Reynolds number. Although the pressure margin L is theoretically 2 mm, it is preferably set to 5 mm by taking a factor of safety into account.

Figure 1A:
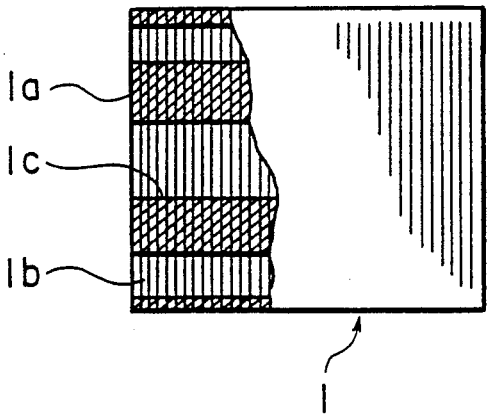
FIG. 1A PRIOR ART
FIGS. 1A and 1B are a partially broken away front elevational view and a side elevational view, respectively, showing a conventional rotor core of a general type.
Figure 1B:
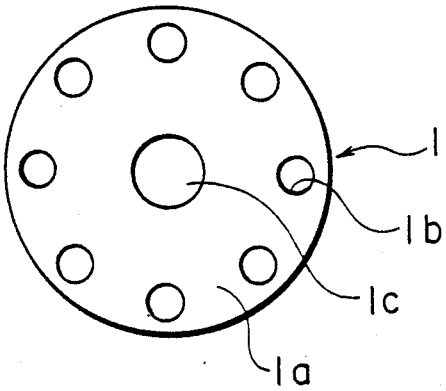
FIG. 1B PRIOR ART
Figure 2:
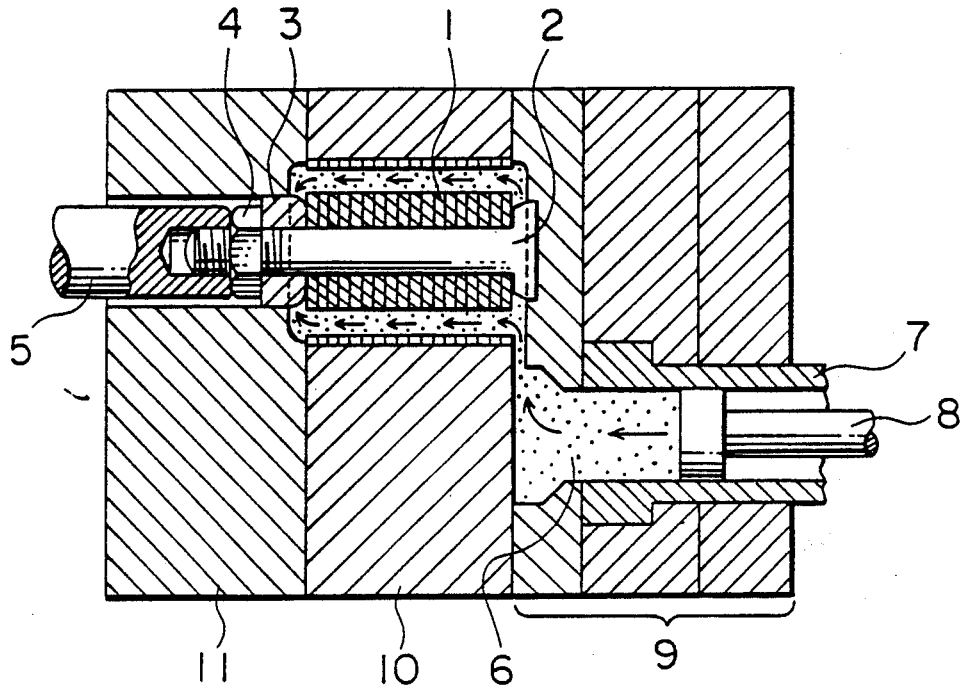
FIG. 2 PRIOR ART
FIG. 2 is a cross-sectional view showing a casting apparatus for conventional squirrel-cage rotors.
Figure 3A:
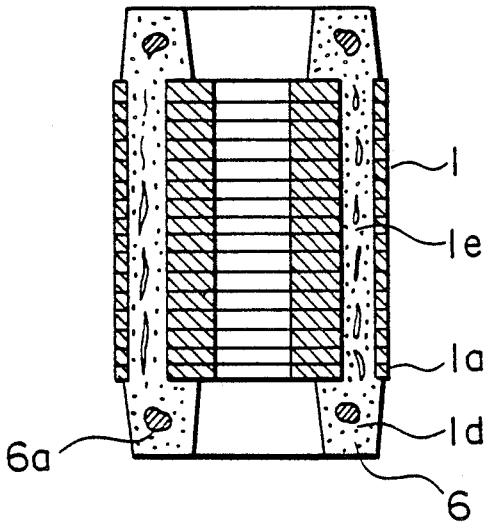
FIG. 3A PRIOR ART
FIGS. 3A and 3B are a cross-sectional view and a side elevational view, respectively, showing such a conventional rotor core.
Figure 3B:
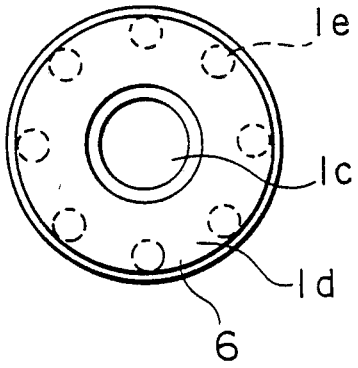
FIG. 3B PRIOR ART
Figure 4:
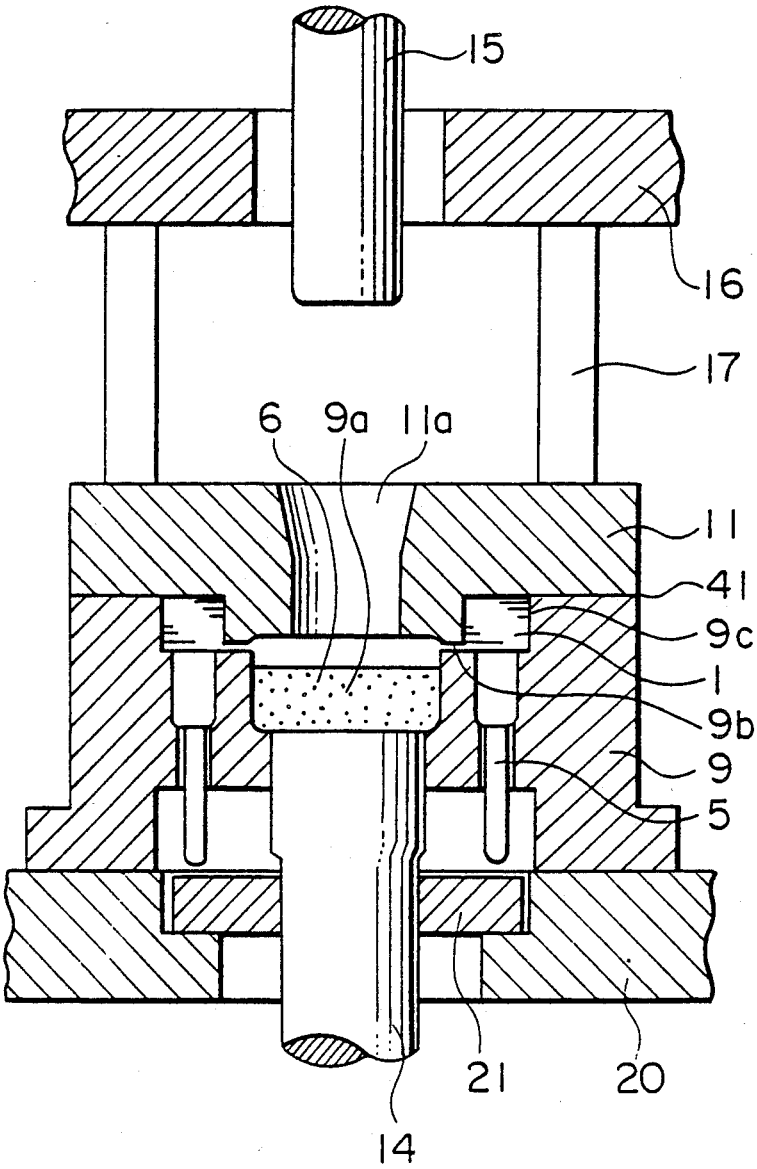
FIG. 4 PRIOR ART
FIG. 4 is a cross-sectional view showing a casting apparatus for conventional squirrel-cage rotors.
Figure 5:
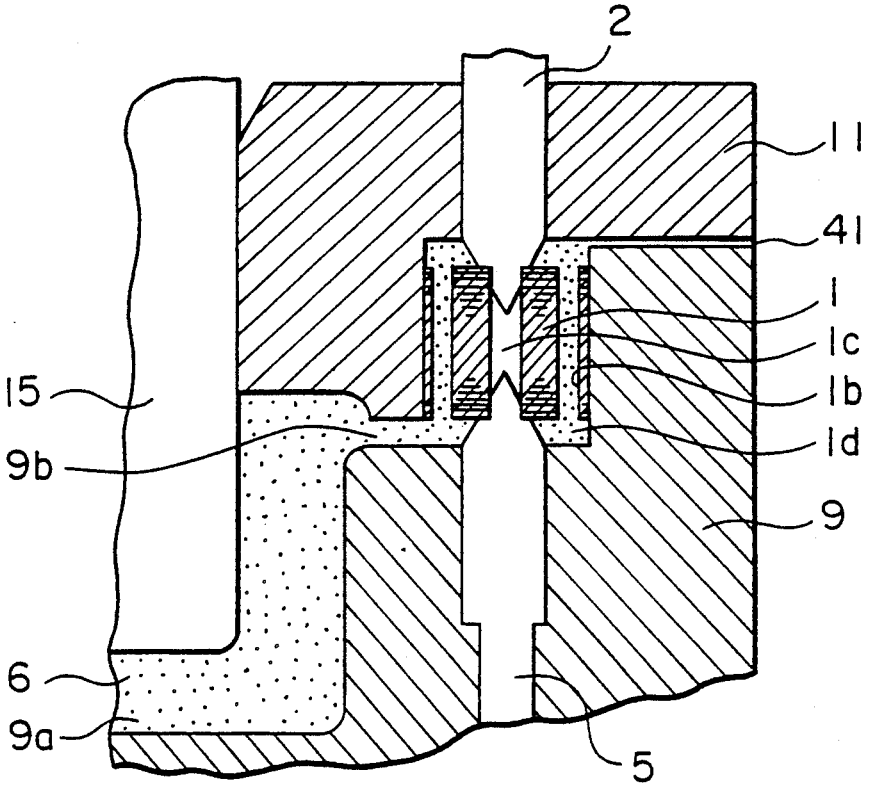
FIG. 5 PRIOR ART
FIG. 5 is a partial enlarged view of the casting apparatus shown in FIG. 4.
Figure 6A:
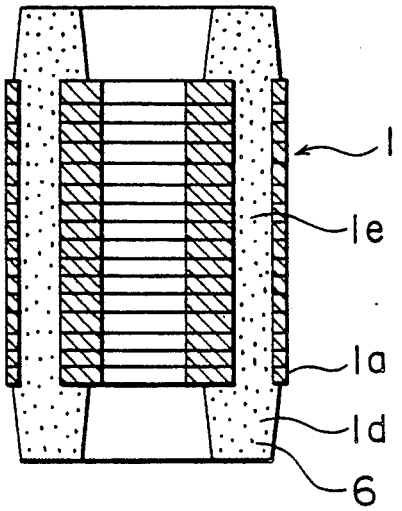
FIG. 6A PRIOR ART
FIGS. 6A and 6B are a cross-sectional view and a side elevational view, respectively, showing a squirrel-cage rotor produced by a squeeze casting method.
Figure 6B:
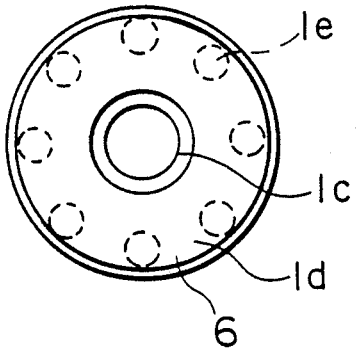
FIG. 6B PRIOR ART
Figure 7:
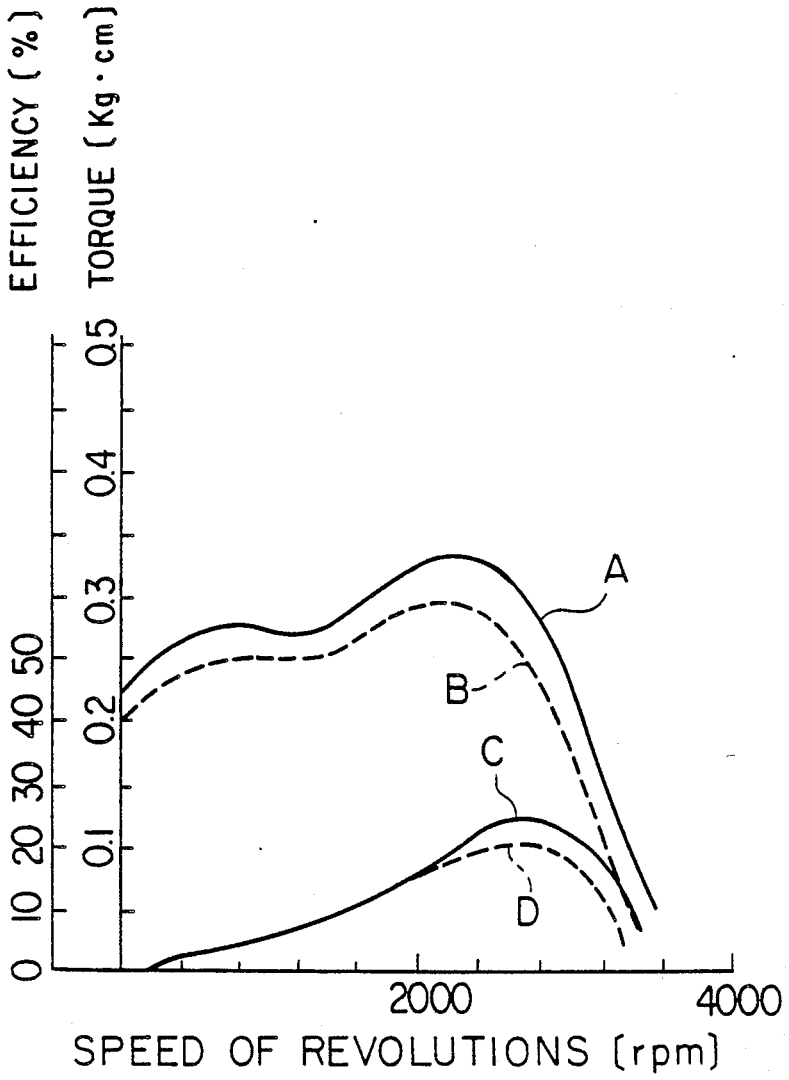
FIG. 7 PRIOR ART
FIG. 7 is a characteristic chart showing the torque characteristics and the efficiency of a squirrel-cage rotor produced by the squeeze casting process in comparison with those of a squirrel-cage rotor produced by a die-casting process.

As can be seen from FIG. 4, in general, the cross-sectional area of each slot 1*b* is selected to be small compared to that of the end ring 1*d* and the slots 1*b* are connected to the end ring portion 1*d* in such a manner that they are arranged around the circumference of the end ring portion 1*d*. Accordingly, the molten conductive material 6 in the slots 1*b* may solidify more rapidly than the end ring portion 1*d*, depending upon the balance of the dimensions of each slot 1*b* and the end ring portion 1*d*.

In this case, the pressure applied by the top pressure plunger 8*a* does not reach the top end ring portion 11*e*, with the result that the molten conductive material 6 in the top end ring portion 11*e* may solidify under normal pressure or insufficient pressure and the shrinkage cavities 6*a* may be formed approximately in the middle of the cross section of the top end ring portion 11*e*.

To avoid such phenomenon, in Embodiment 8, the bottom of the top die 11 and the top of the rotor core 1 are spaced apart from each other by the pressure margin 1 so that the rotor core 1 can move axially in the upward direction along the temporary holding shaft 2. Accordingly, even if the molten conductive material 6 charged in the slots 1*b* solidifies and that charged in the top end ring portion 11*e* is left in a molten or semi-molten state, the rotor core 1 is moved axially in the upward direction due to a differential pressure between the opposite ends of the rotor core 1 which is generated from the solidification of the molten conductive material 6 charged in the slots 1*b*, that is, due to pressure acting on the bottom of the rotor core 1, thereby apply pressure to the top end ring portion 11*e*. Accordingly, it is possible to continuously transmit pressure to the top end ring portion 11*e* through the rotor core 1. In other words, the rotor core 1 acts as a piston by utilizing the intermediate die 10 as a cylinder and maintains the top end ring portion 11*e* at the required high pressure, thereby solidifying the molten conductive material 6 under high pressure to prevent occurrence of the shrinkage cavities 6*a*.

In Embodiment 8, during charging of the molten conductive material 6, the rotor core 1 is held by friction due to mating engagement with the temporary holding shaft 2 so as not to move axially upwardly due to the flow resistance of the molten conductive material 6. After charging of the molten conductive material 6, the rotor core 1 is held so that it can move axially upwardly due to a rising pressure (i.e., a differential pressure between the opposite ends of the rotor core 1). However, the holding method may be of any other type that has a similar function.

Figure 16:
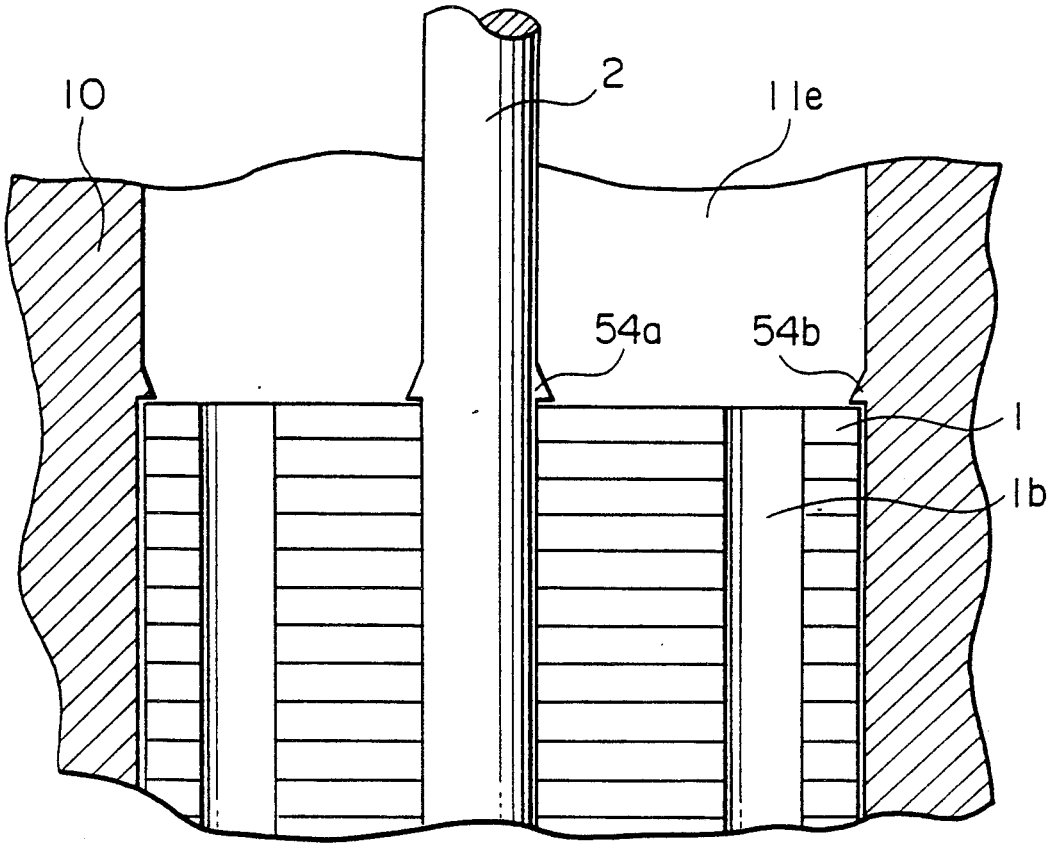

FIG. 16 is an essential cross-sectional view illustrating a rotor-core holding method according to one modification of Embodiment 8. As illustrated, the temporary holding shaft 2 and the intermediate die 10 are provided with engagement portions, for example, small projections 54*a* and 54*b*. The small projections 54*a* and 54*b* engage with the rotor core 1 to prevent it from floating while the molten conductive material 6 is being charged. The rotor core 1 moves up due to a pressure (differential pressure) rising after the charging and elastically deforms the small projections 54*a* and 54*b*, thereby disengaging itself from them. The small projections 54*a* and 54*b* can be easily formed by means of a chisel or spot welding, for example, after the rotor core 1 is fitted onto the temporary holding shaft 2. Accordingly, the method according to this modification is simple and easy compared to the method of Embodiment 8 utilizing friction due to mating engagement.

Figure 17:
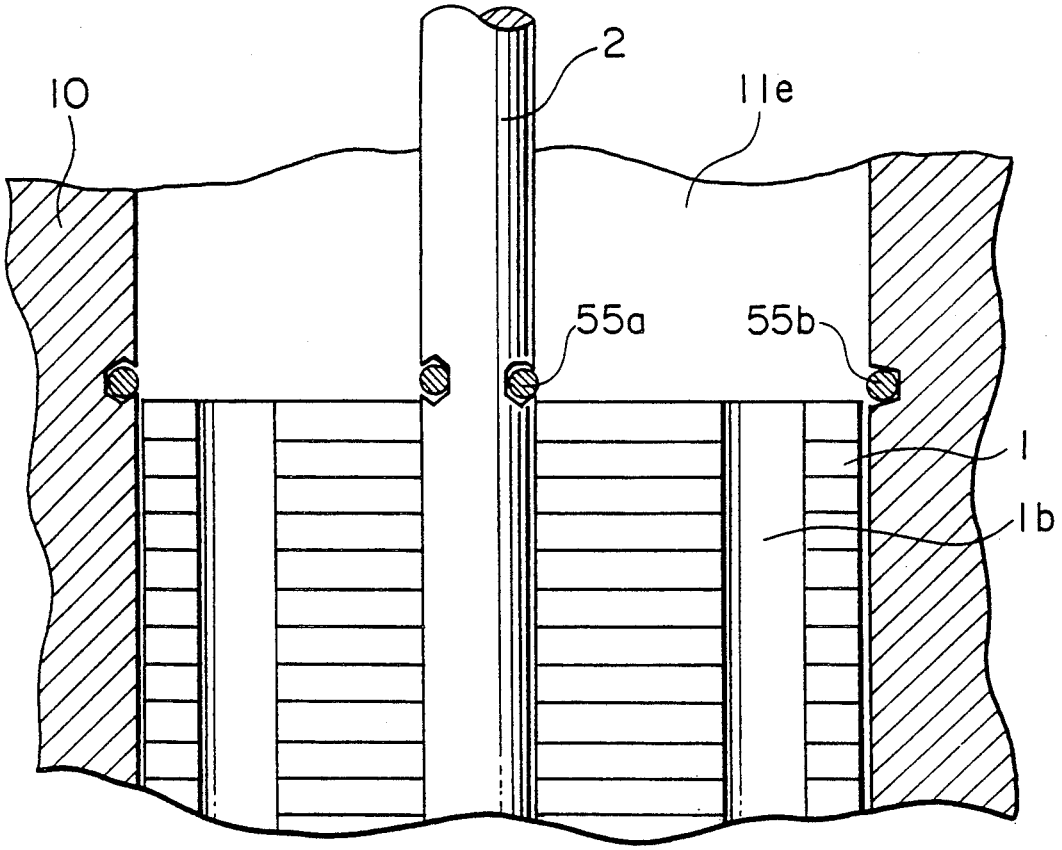

FIG. 17 is an essential cross-sectional view illustrating a rotor-core holding method according to another modification of Embodiment 8. As illustrated, the temporary holding shaft 2 and the intermediate die 10 are provided with engagement portions, for example, recesses, and small balls 55*a* and 55*b* are retained in the respective recesses. The rotor core 1 is arranged to be held by the small balls 55*a* and 55*b*, yielding advantages similar to those of the modification shown in FIG. 16. In this arrangement, the rotor core 1 moves up to elastically deform the small projections 54*a* and 54*b*, thereby disengaging itself from them.

Such engagement portions may be formed on either the temporary holding shaft 2 or the intermediate die 10.

EMBODIMENT 9

Figure 18:
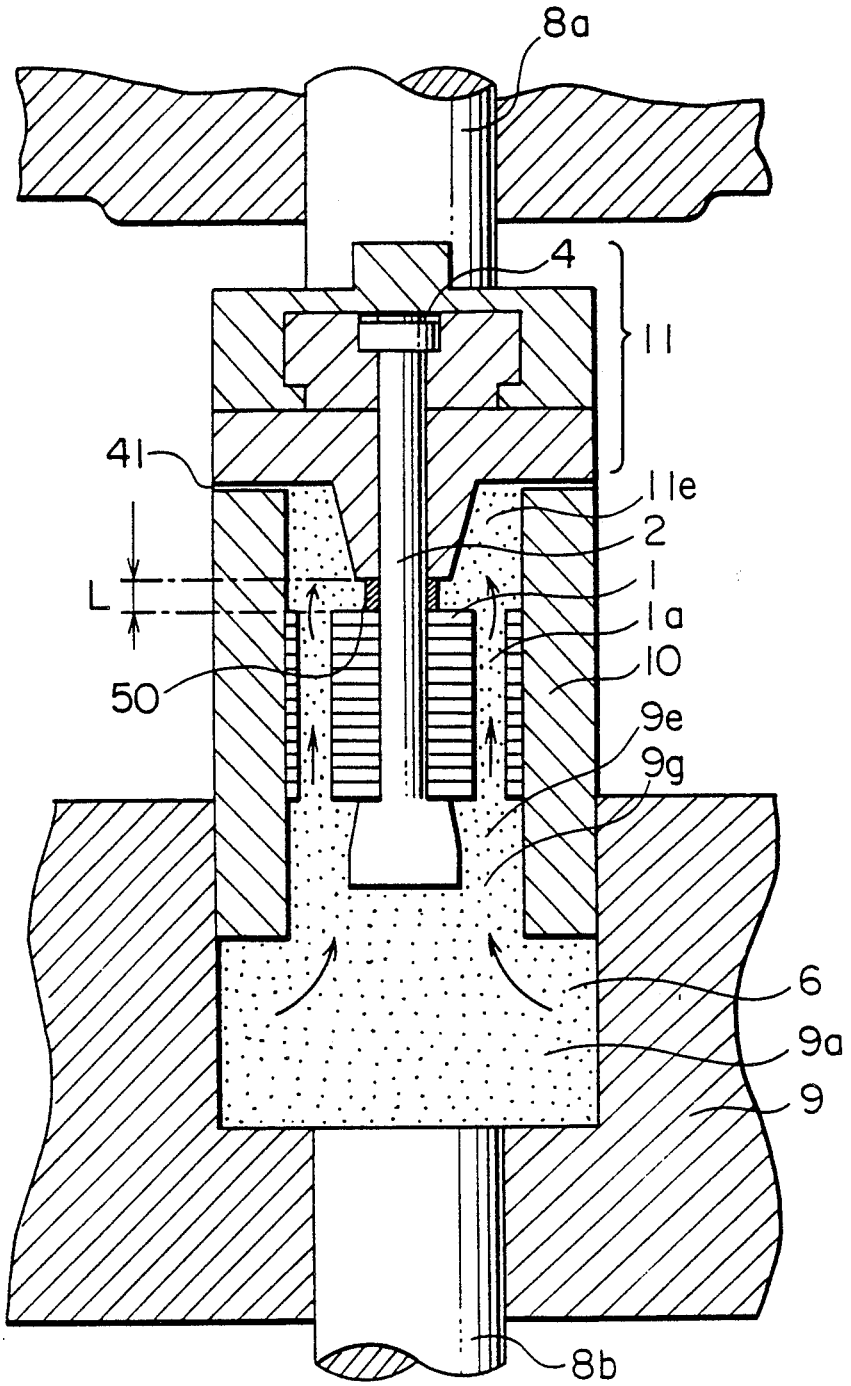
FIGS. 18–25 are cross-sectional views, respectively, showing manufacturing apparatus for squirrel-cage rotors according to ninth to sixteenth embodiments of the present invention.

FIG. 18 is a cross-sectional view showing a manufacturing apparatus for squirrel-cage rotors according to Embodiment 9 of the present invention. As illustrated, a metallic spacer 50 is inserted between the top of the rotor core 1 and the bottom of the top die 11. The metallic spacer 50 serves to determine a length corresponding to the pressure margin L and also to retain the rotor core 1 at a predetermined position until the molten conductive material 6 is charged into the top end ring portion 11*e* through the slots 1*b*. The spacer 50 may be made of the same material as the molten conductive material 6 or similar metallic material having good electrical characteristics. As the result of solidification, the spacer 50 can form a part of the end ring by fusing with the charged conductive material 6 due to the high temperature and high pressure of the molten conductive material 6. In this modification, the spacer 50 is a ring made of aluminum which is the same as the molten conductive material 6.

In the manufacturing method according to Embodiment 9, the rotor core 1 and the spacer 50 are sequentially fitted onto the temporary holding shaft 2, which is in turn secured to the top die 11 with the nut 4. Then, the rotor core 1 is fitted into the intermediate die 10, and the dies thus assembled, which constitute the top movable dies 70, are secured to the top pressure plunger 8*a*. Then, a predetermined amount of molten conductive material 6, such as molten aluminum, is poured into the liquid metal reservoir 9*a* formed in the bottom die 9. Subsequently, the top pressure plunger 8*a* is moved down to insert the top movable dies 70 into the liquid metal reservoir 9*a*, thereby applying a high pressure of 400 kg/cm$^2$ to the product by means of the same process as that explained in Embodiment 8.

In general, as explained in connection with Embodiment 8, shrinkage cavities may be formed substantially in the middle of the cross-sectional area of the top end ring portion 11*e*. However, even in Embodiment 9, even if the molten conductive material 6 charged in the slots 1*b* solidifies and that charged in the top end ring portion 11*e* is left in a molten or semi-molten state, the molten conductive material 6 in the slots 1*b* solidifies, making it possible to continuously transmit pressure to the top end ring portion 11*e* through the rotor core 1 on the basis of the principle explained in connection with Embodiment 8. More specifically, the spacer 50 is melt and deformed due to a high temperature and a high pressure which rises immediately after the molten conductive material 6 is charged, and the rotor core 1, which is retained by the spacer 50 until the molten conductive material 6 is charged, moves axially in the upward direction. Thus, the rotor core 1 acts as a piston by utilizing the intermediate die 10 as a cylinder and maintains the top end ring portion 11*e* at the required high pressure, thereby solidifying the molten conductive material 6 under high pressure to prevent occurrence of the shrinkage cavities 6*a*.

In addition, the use of the spacer 50 makes it possible to easily determine the pressure margin L and the amount of movement of the rotor core 1, thereby facilitating positioning and maintenance of the rotor core 1.

As in the case of Embodiment 9 in particular, if the spacer 50 is made of the same material as the conductive material 6, it is possible to produce an end ring which does not impair material strength and electrical characteristics inherent in the conductive material 6. Accordingly, a ring-shaped spacer is advantageous in that a nonuniform part is eliminated.

EMBODIMENT 10

Figure 19:
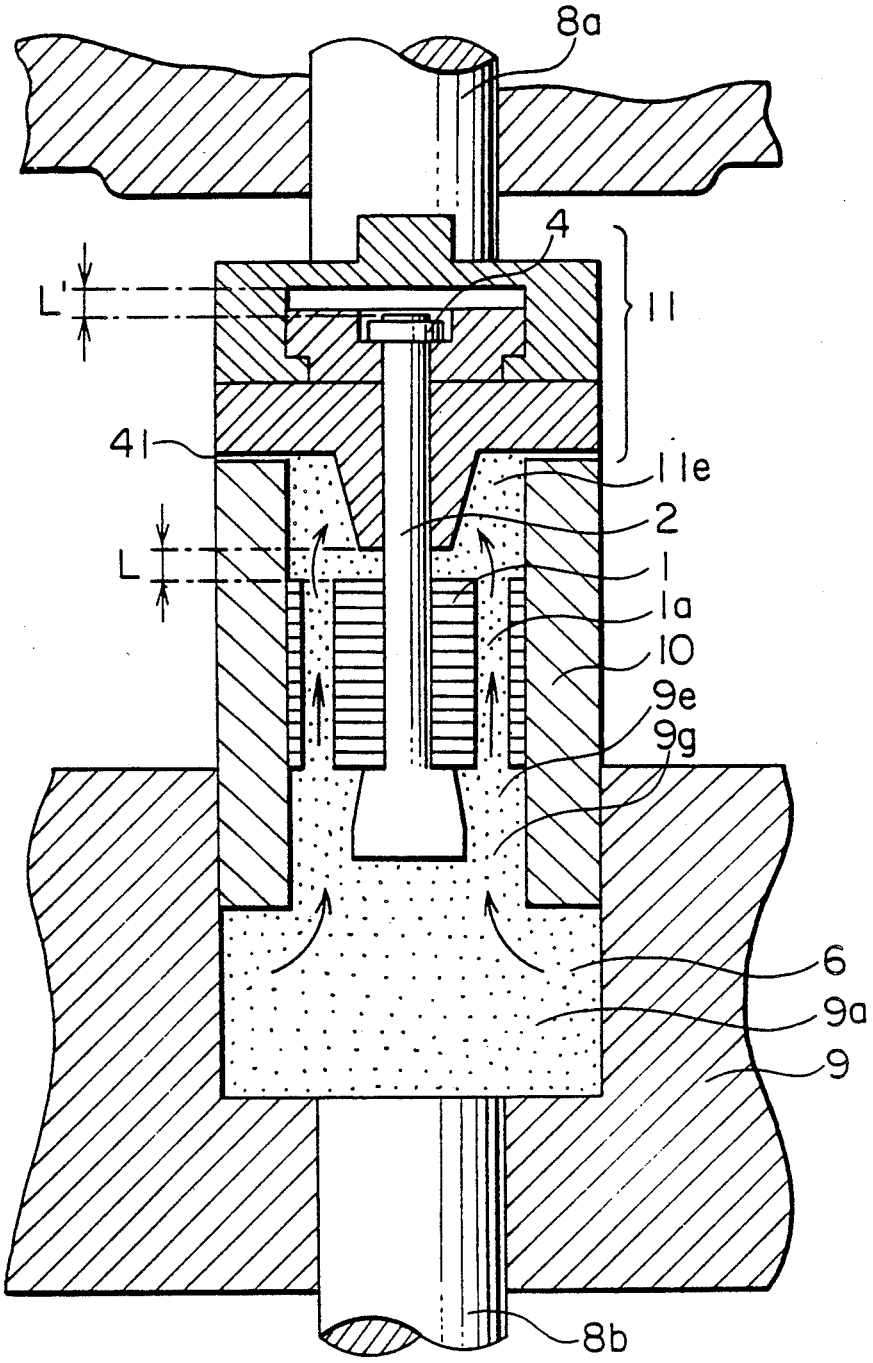

FIG. 19 is a cross-sectional view showing a manufacturing apparatus for squirrel-cage rotors according to Embodiment 10 of the present invention. In this embodiment, the temporary holding shaft 2 can also move in the axial direction.

The top of the rotor core 1 and the bottom of the top die 11 are spaced apart from each other by the pressure margin L which allows the rotor core 1 to move axially in the upward direction to apply pressure to the top end ring portion 11*e*. The top of the temporary holding shaft 2 and the ceiling of the top die 11 are spaced apart from each other by a gap L′ so that the temporary holding shaft 2 can move in the axial direction. In this arrangement, the requirement of $L \geqq C$ need be satisfied, where C represents the amount by which the rotor core 1 moves in the axial direction as the result of shrinkage due to solidification of the conductive material. This requirement applies to other embodiments and, if the requirement is not satisfied, sufficient pressure cannot be applied.

In the manufacturing method according to Embodiment 10, the rotor core 1 is fitted onto the temporary holding shaft 2, which is in turn secured to the top die 11 with the nut 4. In this step, the length of the gap L′ is adjusted by turning the nut 4. In addition, the rotor core 1 is fitted into the intermediate die 10, and the dies thus assembled, which constitute the top movable dies 70, are secured to the top pressure plunger 8*a*. The rotor core 1 is held in a predetermined position within the dies by means of, for example, friction resulting from engagement between the temporary holding shaft 2 and the rotor core 1 until the molten conductive material 6 is completely charged.

Then, a predetermined amount of molten conductive material 6 is poured into the liquid metal reservoir 9*a* formed in the bottom die 9. Subsequently, the top pressure plunger 8*a* is moved down to insert the top movable dies 70 into the liquid metal reservoir 9*a*, thereby effecting application of pressure. In this step, a high pressure of 400 kg/cm$^2$ is applied to the product by means of the same process as that explained in Embodiment 8.

In Embodiment 10, the pressure margin L is defined between the bottom of the top die 11 and the top of the rotor core 1, while the gap L′ is defined between the top of the temporary holding shaft 2 and the ceiling of the top die 11, whereby the rotor core 1 and the temporary holding shaft 2 can be moved axially in the upward direction. Accordingly, even if the molten conductive material 6 charged in the slots 1*b* solidifies and that charged in the top end ring portion 11*e* is left in a molten or semi-molten state, the molten conductive material 6 in the slots 1*b* solidifies, making it possible to continuously transmit pressure to the top end ring portion 11*e* through the rotor core 1 on the basis of the principle explained in connection with Embodiment 8. Accordingly, it is possible to prevent occurrence of shrinkage cavities.

In the case of Embodiment 10, the setting of L or L′ may be varied, depending upon how the rotor core 1 is held.

For instance, if the rotor core 1 is secured to the temporary holding shaft 2, it is necessary to satisfy the relationship of $L' > L > C$.

If the rotor core 1 is not secured to the temporary holding shaft 2 and can be relatively displaced, a vertically symmetrical rotor can be formed by selecting $2L' = L = C$. In general, the requirement of $2L' = L \geqq C$ may be satisfied.

EMBODIMENT 11

Figure 20:
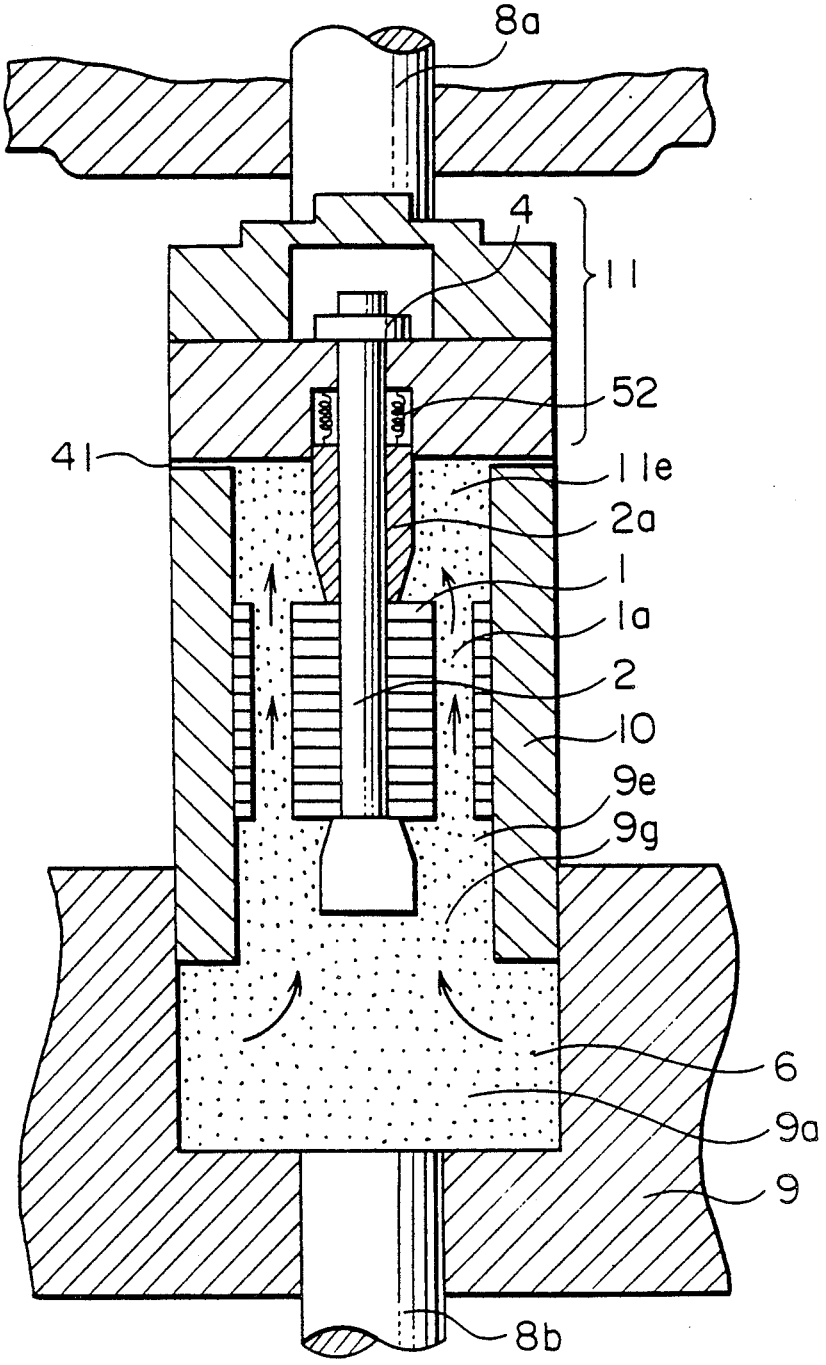

FIG. 20 is a cross-sectional view showing a manufacturing apparatus for squirrel-cage rotors according to Embodiment 11 of the present invention. As illustrated, a temporary cover 2*a* is threaded onto, for example, the temporary holding shaft 2 to secure the rotor core 1 thereto, and also forms the inner peripheral wall of the top end ring portion 11*e*. The top of the temporary holding shaft 2 and the ceiling of the top die 11 are spaced apart from each other by a predetermined gap so that the temporary holding shaft 2 can move axially in the upward direction. The rotor core 1 is made integral with the temporary holding shaft 2 through the temporary cover 2*a*, thereby forming a floating core. Elastic members, for example, springs 52, are disposed to hold the floating core in a predetermined position until the molten conductive material 6 is charged into the top end ring portion 11*e* through the slots 1*b*. After the molten conductive material 6 has been charged, the springs 52 are elastically deformed and compacted due to a high pressure rising after the charging (a differential pressure between the opposite ends of the rotor core 1). The springs 52 are provided at a location where the product configuration is not substantially influenced, that is, they are incorporated into the top die 11. The springs 52 may be replaced with spacers of the type which can perform a similar function by plastic deformation.

In the manufacturing method according to Embodiment 11, the rotor core 1 is fitted onto the temporary holding shaft 2 and is then secured in position by the temporary cover 2*a*, thereby forming the floating core. After the springs 52 have been set, the floating core is fitted into the intermediate die 10 and secured to the top die 11, and the top movable dies thus assembled are secured to the top pressure plunger 8*a*. Then, a predetermined amount of molten conductive material 6, such as molten aluminum, is poured into the liquid metal reservoir 9*a* formed in the bottom die 9. Subsequently, the top pressure plunger 8*a* is moved down to insert the top movable dies into the liquid metal reservoir 9*a*, thereby effecting application of pressure. In this step, a high pressure of 400 kg/cm$^2$ is applied to the product by means of the same process as that explained in Embodiment 8.

In Embodiment 11, the rotor core 1, the temporary holding shaft 2 and the temporary cover 2*a* are integrated into the floating core, and the ceiling of the top die 11 are spaced apart from each other by the predetermined gap so that the floating core can move axially in the upward direction. Accordingly, even if the molten conductive material 6 charged in the slots 1*b* solidifies and that charged in the top end ring portion 11*e* is left in a molten or semi-molten state, the molten conductive material 6 in the slots 1*b* solidifies, making it possible to continuously transmit pressure to the top end ring portion 11*e* through the rotor core 1 on the basis of the principle explained in connection with Embodiment 8. More specifically, the floating core, which is secured by the springs 52 until the molten conductive material 6 is charged, moves axially in the upward direction due to a high pressure which rises immediately after the molten conductive material 6 is charged. Accordingly, the rotor core 1 acts as a piston by utilizing the intermediate die 10 as a cylinder and maintains the top end ring portion 11*e* at the required high pressure, thereby solidifying the molten conductive material 6 under high pressure to prevent occurrence of shrinkage cavities.

As described above, in Embodiment 11, the temporary cover 2*a* forms the inner circumferential wall of the top end ring portion 11*e* and the bottom of the top die 11 is flat, whereby manufacturing of the top die 11 is facilitated.

EMBODIMENT 12

Figure 21:
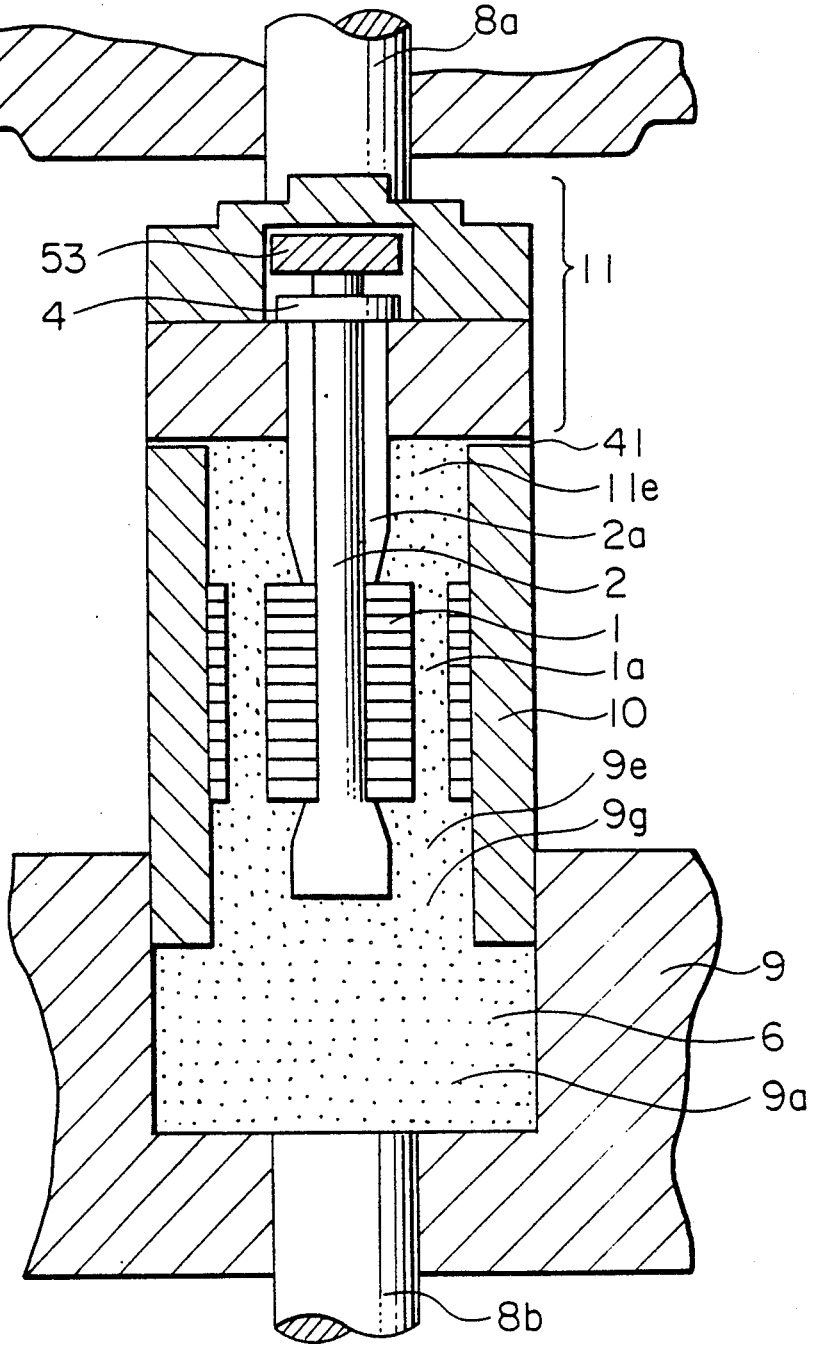

FIG. 21 is a cross-sectional view showing a manufacturing apparatus for squirrel-cage rotors according to Embodiment 12 of the present invention. As illustrated, a weight 53 is mounted on one end of the temporary shaft 2. The weight 53 serves to retain a floating core constituted by the rotor core 1, the temporary holding shaft 2 and the temporary cover 2*a* in a predetermined position, thereby preventing the floating core from being moved due to flow resistance occurring when the molten conductive material 6 is charged. The weight 53 must be heavy enough for the floating core to move up due to a pressure rising after the molten conductive material 6 has been charged.

In the manufacturing method according to Embodiment 12, the rotor core 1 is fitted onto the temporary holding shaft 2 and is then secured in position by the temporary cover 2*a*, thereby forming the floating core. Then, the floating core is fitted into the intermediate die 10 and secured to the top die 11. Then, the weight 53 is set in a space formed in the top die 11 and placed on the top of the temporary holding shaft 2 so that the floating core is not moved upwardly when the molten conductive material 6 has been charged. The above elements, which constitute top movable dies, are secured to the top pressure plunger 8*a*.

Then, a predetermined amount of molten conductive material 6, such as molten aluminum, is poured into the liquid metal reservoir 9*a* formed in the bottom die 9. Subsequently, the top pressure plunger 8*a* is moved down to insert the top movable dies into the liquid metal reservoir 9*a*, thereby effecting application of pressure. In this step, the pressure applied by the top pressure plunger 8*a* rapidly rises to apply a high pressure of 400 kg/cm$^2$ to the product through the same process as that explained in Embodiment 8.

In Embodiment 12, it is possible to continuously transmit pressure to the top end ring portion 11*e* on the basis of operations and principles similar to those explained in connection with Embodiment 8. Accordingly, the molten conductive material 6 can be solidified under high pressure by maintaining the top end ring portion 11*e* at the required high pressure, so that the occurrence of shrinkage cavities can be prevented and advantages similar to those of Embodiment 11 can be enjoyed.

Any of the above Embodiments 8–12 of the present invention utilizes the method of applying pressure by means of the top pressure plunger 8*a*. However, after the top movable dies have been inserted into the bottom die 9 by the motion of the above pressure plunger 8*a*, the bottom pressure plunger 8*b* may be utilized to charge the molten conductive material 9 in to the dies and apply pressure thereto.

EMBODIMENT 13

Figure 22:
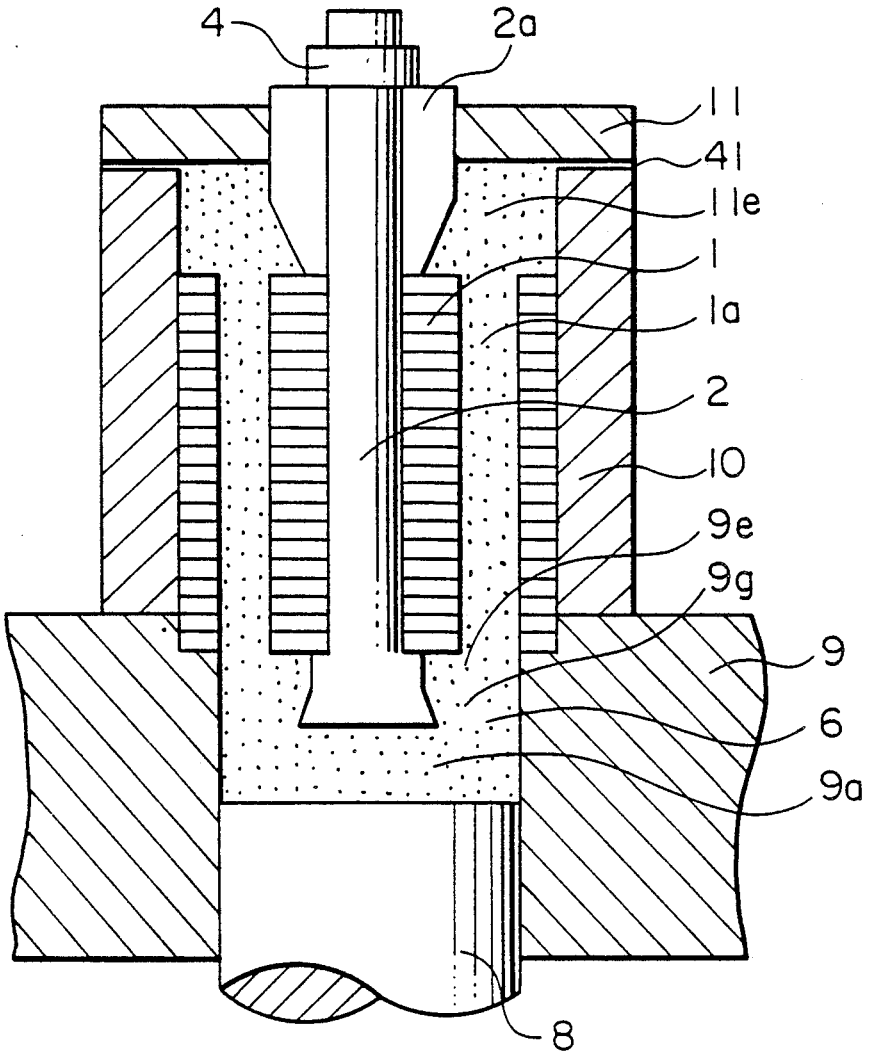

FIG. 22 is a cross-sectional view showing a manufacturing apparatus for squirrel-cage rotors according to Embodiment 13 of the present invention. This embodiment is suitable for use in manufacturing large rotor cores (of large deadweight). As illustrated, the top die 11 defines the end face of the top end ring portion 11*e*, which is formed adjacent to the bottom of the top die 11. Gas discharge channels 41 provide communication between the top end ring portion 11*e* and the exterior to discharge air or gas from the cavity. The pressure plunger 8 charges the molten conductive material 6 into the dies and applies pressure thereto. The pressure plunger 8 also serves to extrude the product after the molten conductive material has been completely solidified. The intermediate die 10 defines a flow passage for the molten conductive material 6 and serves as a heat insulation wall for the heated rotor core 1. The intermediate die 10 is also provided with the bottom end ring portion 9*e* and the gate 9*g* for introducing into the intermediate die 10 the molten conductive material 6 accommodated in the liquid metal reservoir 9*a* formed in the bottom die 9. The temporary holding shaft 2 holds the rotor core 1. The temporary holding shaft 2, the temporary cover 2*a* and the rotor core 1 are integrally assembled by means of the nut 4, thus forming a floating core. The temporary cover 2*a* forms the inner circumferential wall of the top end ring portion 11*e*.

In the manufacturing method according to Embodiment 13, the rotor core 1 and the temporary cover 2*a* are sequentially fitted onto the temporary holding shaft 2, which is in turn secured in position with the nut 4 to form a floating core. Then, the floating core is fitted into the intermediate die 10 and the top die 11 is placed on the top of such assembly, thereby forming top dies. Then, a predetermined amount of molten conductive material 6, such as molten aluminum, is poured into the liquid metal reservoir 9*a* formed in the bottom die 9. Subsequently, the top dies are secured to the bottom die 9 and the pressure plunger 8 is moved up to charge the molten conductive material 6 into the top dies for the purpose of pressure application. In this step, a high pressure of 400 kg/cm$^2$ is applied to the product by means of the same process as that explained in Embodiment 8.

In the case of Embodiment 13, axial (upward) movement of the floating core due to flow resistance occurring when the molten conductive material 6 is charged, is prevented by the weight of the floating core itself.

In Embodiment 13 as well, even if the molten conductive material 6 charged in the slots 1*b* solidifies and that charged in the top end ring portion 11*e* is left in a molten or semi-molten state, the molten conductive material 6 in the slots 1*b* solidifies, making it possible to continuously transmit pressure to the top end ring portion 11*e* through the rotor core 1. More specifically, the floating core, which is held in position by its own weight until the molten conductive material 6 is completely charged, is moved axially in the upward direction due to a high temperature which rises immediately after the charging of the molten conductive material 6 (a differential pressure between the opposite ends of the rotor core 1). Thus, the rotor core 1 acts as a piston by utilizing the intermediate die 10 as a cylinder and maintains the top end ring portion 11*e* at the required high pressure, thereby solidifying the molten conductive material 6 under high pressure to prevent occurrence of shrinkage cavities. In addition, the die structure can be simplified.

EMBODIMENT 14

Figure 23:
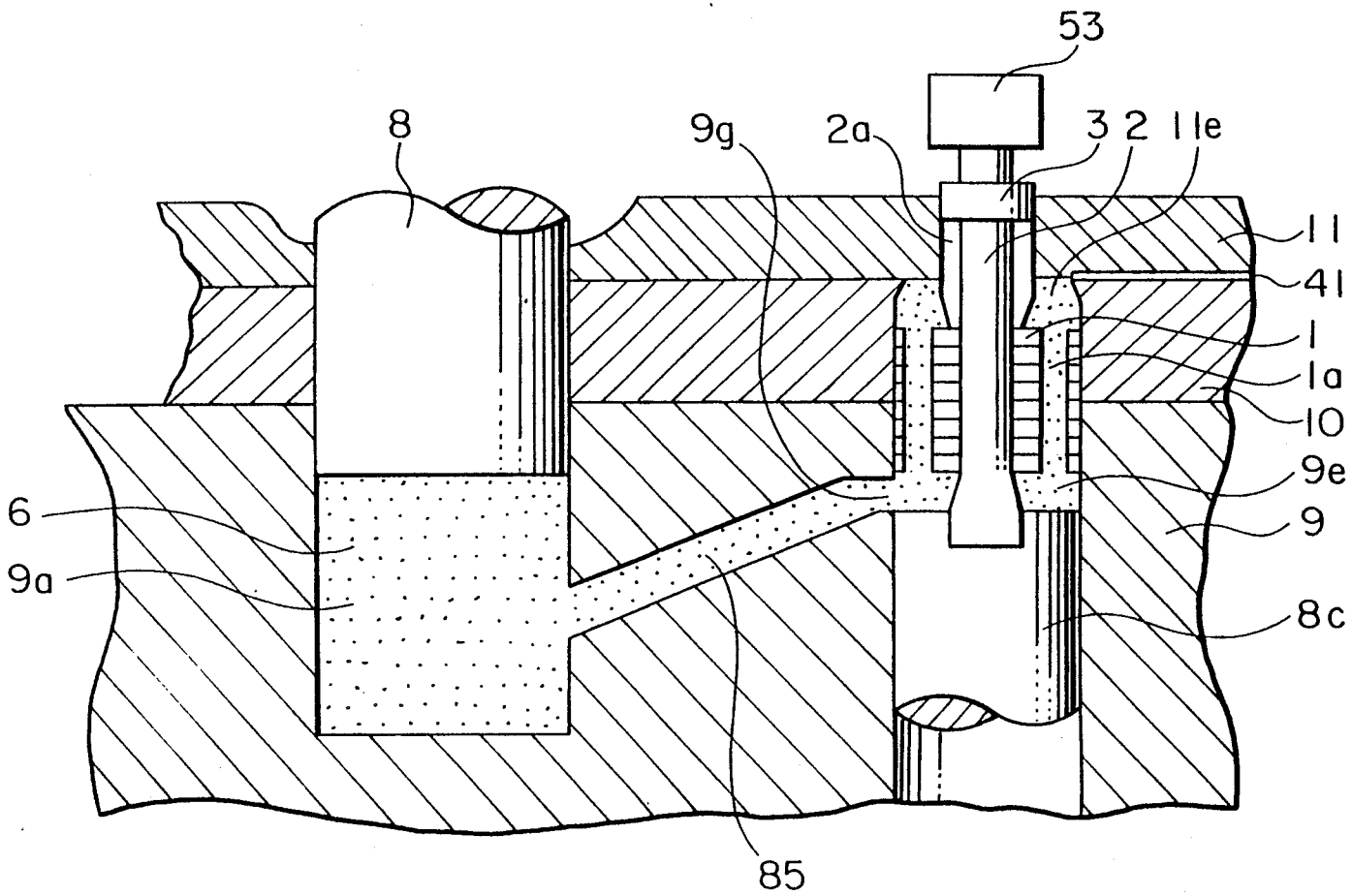

FIG. 23 is a cross-sectional view showing a manufacturing apparatus for squirrel-cage rotors according to Embodiment 14 of the present invention. The arrangement of Embodiment 14 differs from the dies shown in FIG. 22 in that it relates to a method of indirectly charging and applying pressure to molten conductive material as well as a method of indirectly feeding molten conductive material and manufacturing a multiplicity of products at a time. As illustrated, the pressure plunger 8 applies pressure to the molten conductive material 6 accommodated in the liquid metal reservoir 9*a*. The molten conductive material 6 thus pressed is charged into the top end ring portion 11*e*, the bottom end ring portion 9*e* and the top end ring portion 11*e* through a gate 10*a*. At this time, although force which acts to force the rotor core 1 upwardly occurs due to the flow resistance of the molten conductive material 6, the rotor core 1 is maintained in a predetermined position by its own weight. If the rotor core 1 tends to move up due to the flow resistance of the molten conductive material 6, the weight 53 may preferably be mounted as shown in FIG. 23. A punch 8C is arranged for cutting or knockout of products.

In Embodiment 14 as well, it is possible to maintain the top end ring portion 11*e* at the required high pressure on the basis of operations and principles similar to those of the direct liquid metal pouring method of FIG. 22. Accordingly, the molten conductive material 6 can be solidified under high pressure so that the occurrence of shrinkage cavities can be prevented.

Should the molten conductive material 6 solidify in a runner until solidification is completed after it has been charged into the dies, no pressure is transmitted to the molten conductive material 6 charged in the dies. In this case, the punch 8*c* may be moved up to apply pressure to the product.

The configuration of the dies is not limited to that shown in FIG. 22, and the dies according to any of the above embodiments may also be employed.

EMBODIMENT 15

Figure 24:
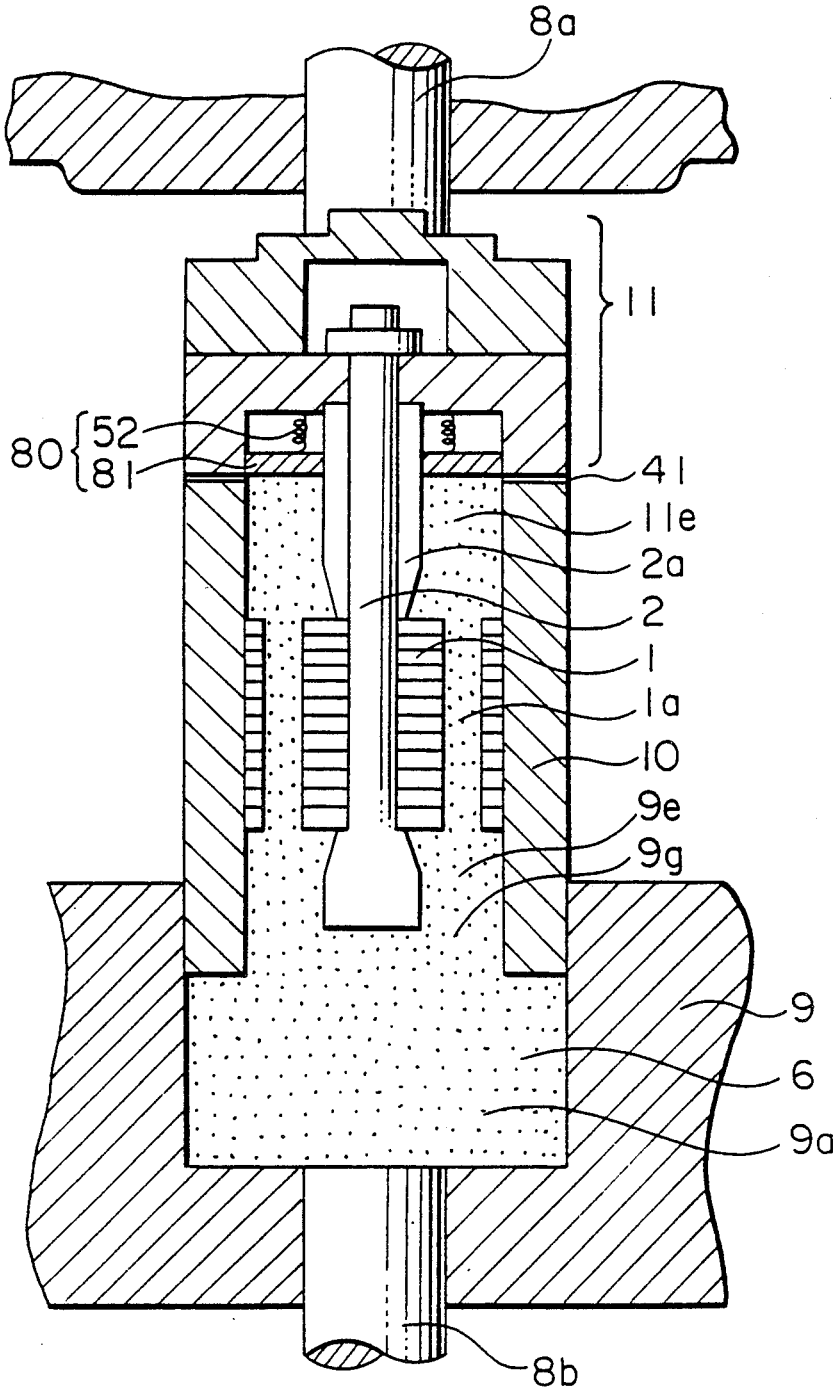

FIG. 24 is a cross-sectional view showing a manufacturing apparatus for squirrel-cage rotors according to Embodiment 15 of the present invention. As illustrated, the temporary cove 2*a* secures the rotor core 1 to the temporary holding shaft 2 and forms the inner circumferential wall of the top end ring portion 11*e*. The rotor core 1 and the temporary cover 2*a* are integrated by the temporary cover 2*a*, forming a core. In Embodiment 15, the core is fixedly mounted in the dies so that it does not move. This embodiment is also provided with a pressure mechanism 80 for applying pressure to the end ring portion. The pressure mechanism 80 is made up of an end-ring pressure plate 81 which defines the end face of the top end ring portion 11*e* and a spring 52 as an elastic member which holds the end-ring pressure plate 81.

In the manufacturing method according to Embodiment 15, the rotor core 1 is fitted onto the temporary holding shaft 2 and secured in position with the temporary cover 2*a*, thereby forming a core. Then, the core is fitted into the intermediate die 10 and the assembly is secured to the top die 11. The assembly as top movable dies is secured to the top pressure plunger 8a. Then, a predetermined amount of molten conductive material 6, such as molten aluminum, is poured into the liquid metal reservoir 9a formed in the preheated bottom die 9. Subsequently, the top pressure plunger 8a is moved down to insert the top movable dies into the liquid metal reservoir 9a, thereby applying pressure to the molten conductive material 6. In this step, the pressure applied by the top pressure plunger 8a rapidly rises through the same process as that explained in Embodiment 8. This applied pressure compresses springs 52 to force the end-ring pressure plate 81 in the upward direction. At the instant when the applied pressure balances the restoring force of the springs 52, the end-ring pressure plate 81 comes to a halt and a high pressure of 400 $kg/cm^2$ or more is applied to the product through the liquid metal reservoir 9a and the gate 9g.

In general, and as explained in connection with Embodiment 8, shrinkage cavities are formed approximately in the middle of the cross section of the top end ring portion 11e.

To avoid such phenomenon, Embodiment 15 is provided with the end-ring pressure mechanism 80. Accordingly, even if the molten conductive material 6 charged in the slots 1b solidifies and that charged in the top end ring portion 11e is left in a molten or semi-molten state, pressure can be applied to the top end ring portion 11e due to the restoring force of the springs 52 which are elastically deformed when the molten conductive material 6 is charged. Accordingly, it is possible to maintain the top end ring portion 11e at the required high pressure, thereby solidifying the molten conductive material 6 under high pressure to prevent occurrence of shrinkage cavities.

The pressure mechanism 80 utilizes pressure which is applied when the molten conductive material 6 is charged into the dies by pressure. Accordingly, it is possible to achieve the advantage that the pressure in the end-ring portion can be maintained without the need to use a separate pressure source and with a simple construction.

The arrangement of the pressure mechanism is not limited to the above example and, for example, the side face of the end ring portion may be pressed or such pressure mechanism may be provided on the bottom end ring portion.

EMBODIMENT 16

Figure 25:
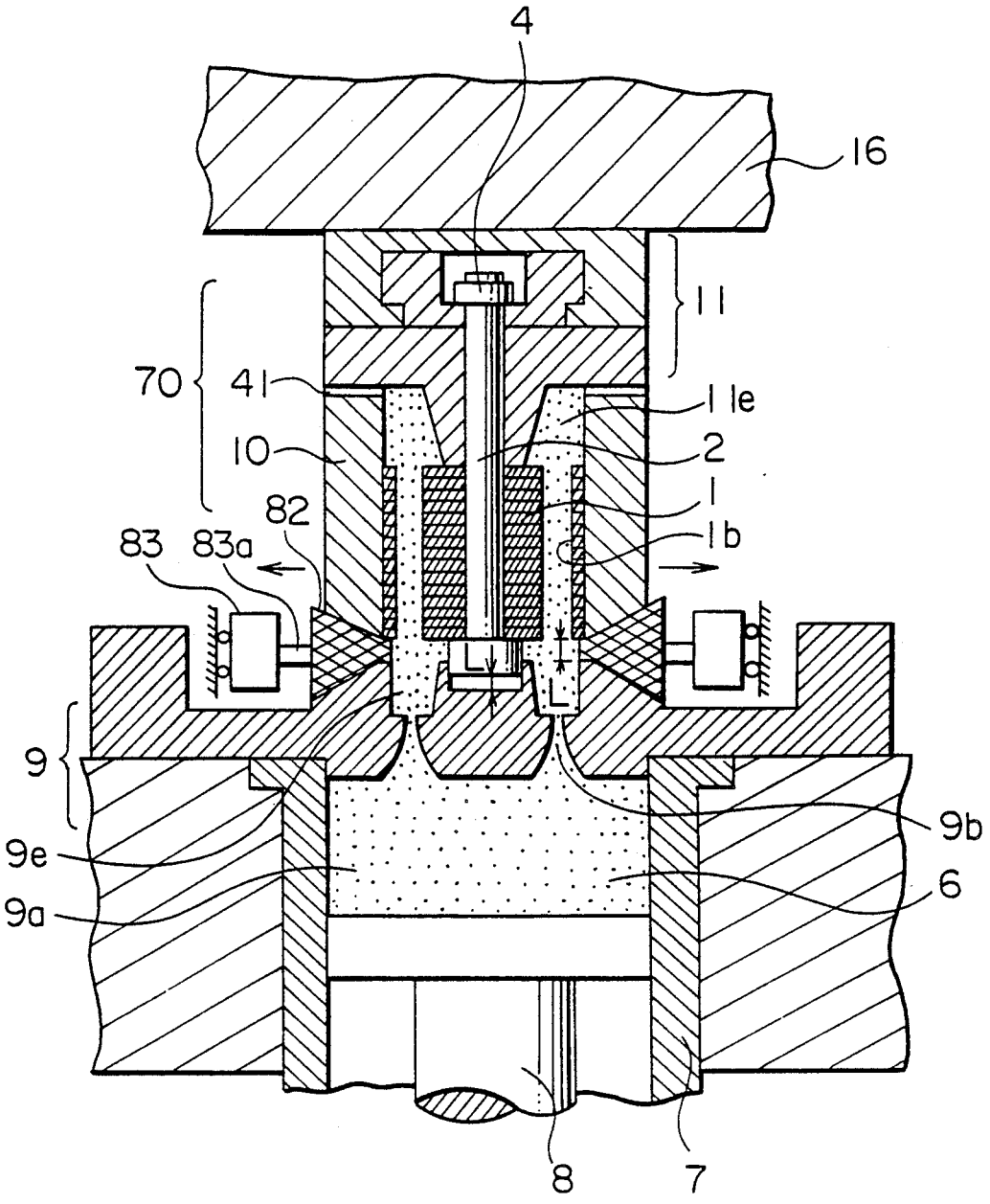

FIG. 25 is a cross-sectional view showing a manufacturing apparatus for squirrel-cage rotors according to Embodiment 16 of the present invention. As illustrated, the top end ring portion 11e is formed by the top die 11 and the intermediate die 10. The intermediate die 10 surrounds the outer circumference of the rotor core 1 made from layers which are stacked in alignment, thereby preventing the molten conductive material 6 from scattering from the gaps between the layers. The bottom die 9 is formed by an upper section and a lower section. The lower section is integrally provided with the sleeve 7 and the liquid metal reservoir 9a is defined between the sleeve 7 and the pressure plunger 8 which is slidably fitted into the sleeve 7 to apply pressure to the molten conductive material 6. The upper section of the bottom die 9 is slidably engaged with the sleeve 7. The upper section of the bottom die 9 is provided with a plurality of gates 9b for introducing the molten conductive material 6 from the liquid metal reservoir 9a into the bottom end ring portion 9e and the intermediate die 10. Spacer means 82, such as a wedge which is divided into four parts, for example, around the circumference, is fitted between the intermediate die 10 and the bottom die 9 in order to form a gap therebetween. Withdrawal devices 83, such as hydraulic cylinders, are secured to the upper section of the bottom die 9 in order to withdraw the spacer means 82 by means of rods 83a in the radial direction. A multiplicity of gas discharge channels 41 are radially formed between the top die 11 and the intermediate die 10. The gas discharge channels 41 serve to conduct gas to the exterior when the molten conductive material 6 is charged into the pressure plunger 8.

It is to be noted that the spacer means 82 is designed to have a configuration which creates a gap corresponding to the pressure margin L between the intermediate die 10 and the upper section of the bottom die 9 so that the top die 11 and the intermediate die 10 can integrally move and so that the upper section of the bottom die 9 can move upwardly. The pressure margin L is provided with the top end ring portion 9e. The size of the pressure margin L is determined by calculating the amount of volumetric reduction resulting from the solidification of the molten conductive material 6 charged in the bottom end ring portion 9e (a phase transition from liquid phase to slid phase). In addition, at least a gap L is formed between the bottom of the temporary shaft 2 and the upper section of the bottom die 9 so that the upper section of the bottom die 9 and the intermediate die 10 can approach each other.

In the manufacturing method according to Embodiment 16, the rotor core 1 is fitted onto the temporary holding shaft 2, which is in turn inserted into an opening formed in the top die 11 and secured thereto with the nut 4. Then, the rotor core 1 is fitted into the intermediate die 10, and the dies thus assembled, which constitute the top movable dies 70, are secured to the slide 16. The spacer means 82 is located in advance at the illustrated position where it is forced out of the interior of the dies by the withdrawal devices 83 to define a part of the outer circumferential wall of the bottom end ring portion 9e. The pressure plunger 8 is located in advance at a predetermined downward position and, in this state, the molten conductive material 6 is poured into the liquid metal reservoir 9a by a liquid metal feeding device (not shown). Then, the upper section of the bottom die 9 is made to engage with the sleeve 7 to shield the interior. Then, the top movable dies 70 move down to bring the intermediate die 10 into contact with the spacers 82, thereby completing die clamping. Finally, the pressure plunger 8 moves up.

In the above step, the molten conductive material 6 is forced into the top end ring portion 11e through the gates 9g, the bottom end ring portion 9e and the slots 1b. It is preferable that the flow velocity of the molten conductive material 6, be made comparatively small (20,000 or less in Reynolds number) in order to prevent an excessive amount of air or gas from entering the molten conductive material 6.

After a major part of air or gas in the dies and slots has been discharged through the gas discharge channels 41 and the molten conductive material 6 has reached the gas discharge channels 41, the portion of the material 6 at or near the gas discharge channels 41 is quenched and solidified.

At this point in time, the pressure applied by the top pressure plunger 8 starts to rapidly rise, whereby a high pressure of 400 $kg/cm^2$ or more is applied to the product through the liquid metal reservoir 9a and the gates 9b. In this step, the molten conductive material 6 charged in the gates 9b and the slots 1b initially solidifies, and the molten conductive material 6 charged in the top and bottom end ring portions 11e and 9e then starts to solidify. The pressure in the top and bottom end ring portions 11e and 9e decreases due to a volumetric reduction resulting from the solidification (phase transition). As described previously, in general, the diameter of the top end portion of each gate 9b can be made extremely small so that the material solidified in the gates 9b can be cut by a die opening action for moving the top movable dies 70 upwardly by the slide 16. For this reason, the time difference in solidification between the bottom end ring portion 9e and the gates 9b is in general larger than that between the top end ring portion 11e and the slots 1b. As a result, in many cases, large shrinkage cavities occur in the bottom end ring portion 11e compared to the top end ring portion 9e.

Embodiment 16 is intended to prevent shrinkage cavities from occurring in the bottom end ring portion 9e and is arranged to withdraw the spacer means 82 by means of the withdrawal devices 31. Accordingly, as the top movable dies 70 are moved by the pressure applied by the slide 16, the upper section of the bottom die 9 is moved upwardly by the pressure applied by the pressure plunger 8, whereby the top end ring portion 9e is strongly pressed. Since the applied pressure is sustained until the solidification is completed, shrinkage cavities are prevented. The size of the pressure margin L may be determined in advance by calculating the volume of the bottom end ring portion 9e and the amount of shrinkage of the molten conductive material 6 due to solidification. When the spacer means 82 is withdrawn, the outer circumference of the upper section of the spacer means 82 is instantaneously exposed to atmospheric air. However, at this point in time, since the periphery of the bottom end ring portion 9e has already solidified to a sufficient extent, there is no risk that the molten conductive material 6 leaks to the exterior.

EMBODIMENT 17

Figure 26:
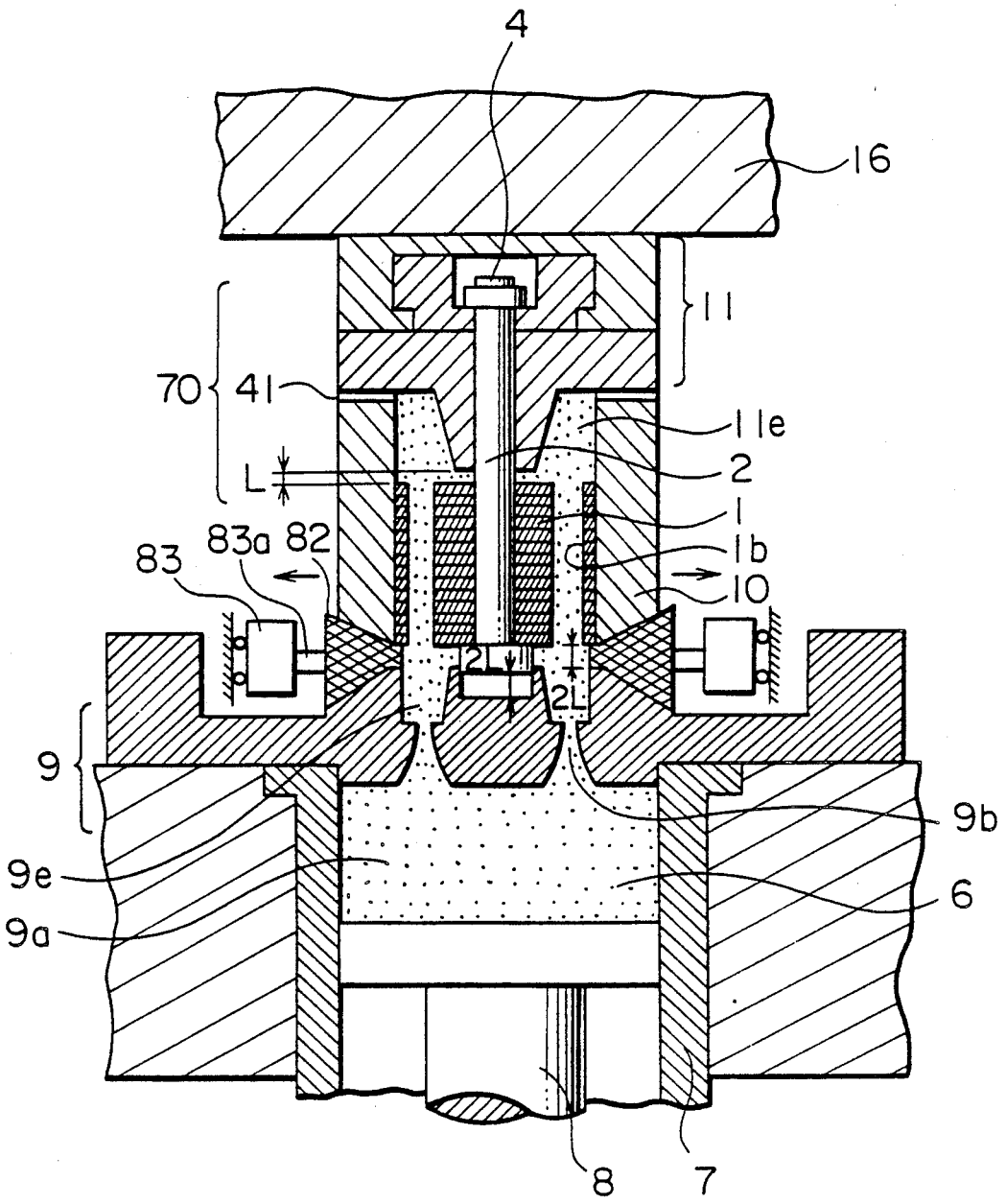
FIGS. 26 and 27 are cross-sectional views, respectively, showing manufacturing apparatus for squirrel-cage rotors according to seventeenth embodiments of the present invention.

Embodiment 17 of the present invention will be explained below with reference to FIG. 26. The construction of Embodiment 17 is substantially the same as that of Embodiment 16 except that the pressure margin L is formed between the top of the rotor core 1 and the bottom of the portion of the top die 11 which defines the inner wall of the top end ring portion 11e and also except that the gap between the top movable dies 70 and the bottom die 9 and that between the gap between the bottom of the temporary holding shaft 2 and the top of the bottom die 8 are each set to 2L.

The procedure of Embodiment 17 is substantially the same as that of Embodiment 16. In Embodiment 17, when a strong pressure is applied to the bottom end ring portion 9e by withdrawing the spacer means 82, a similar strong pressure is applied to the bottom of the rotor core 1, and the rotor core 1 moves up due to the pressure, thereby strongly pressing the top end ring portion 11e. Accordingly, even if the molten conductive material 6 charged in the slots 1b or the gates 9b solidifies earlier, strong pressure is naturally applied to the top and bottom end ring portions 11e and 9e, whereby shrinkage cavities are prevented.

In Embodiment 17, the pressure margin is selected to be L or 2L, that is, L per each end ring portion. However, since the amount of shrinkage is naturally determined by the volume of the end ring portion and the kind of conductive material, the pressure margin may be selected to be larger than L. Also, although the withdrawal devices 83 are made from hydraulic cylinders for the purpose of illustration, motors may be utilized. Although the spacer means 82 is shown as having an approximately wedge-like cross section, the spacer means 82 may be tapered on only one side thereof or may have a rectangular cross-sectional configuration. Although the above embodiment has been illustratively explained with reference to a process for forming one product at a time, it is possible to apply the same process described above to a process for producing a multiplicity of products at a time as shown in FIG. 4.

Figure 27:
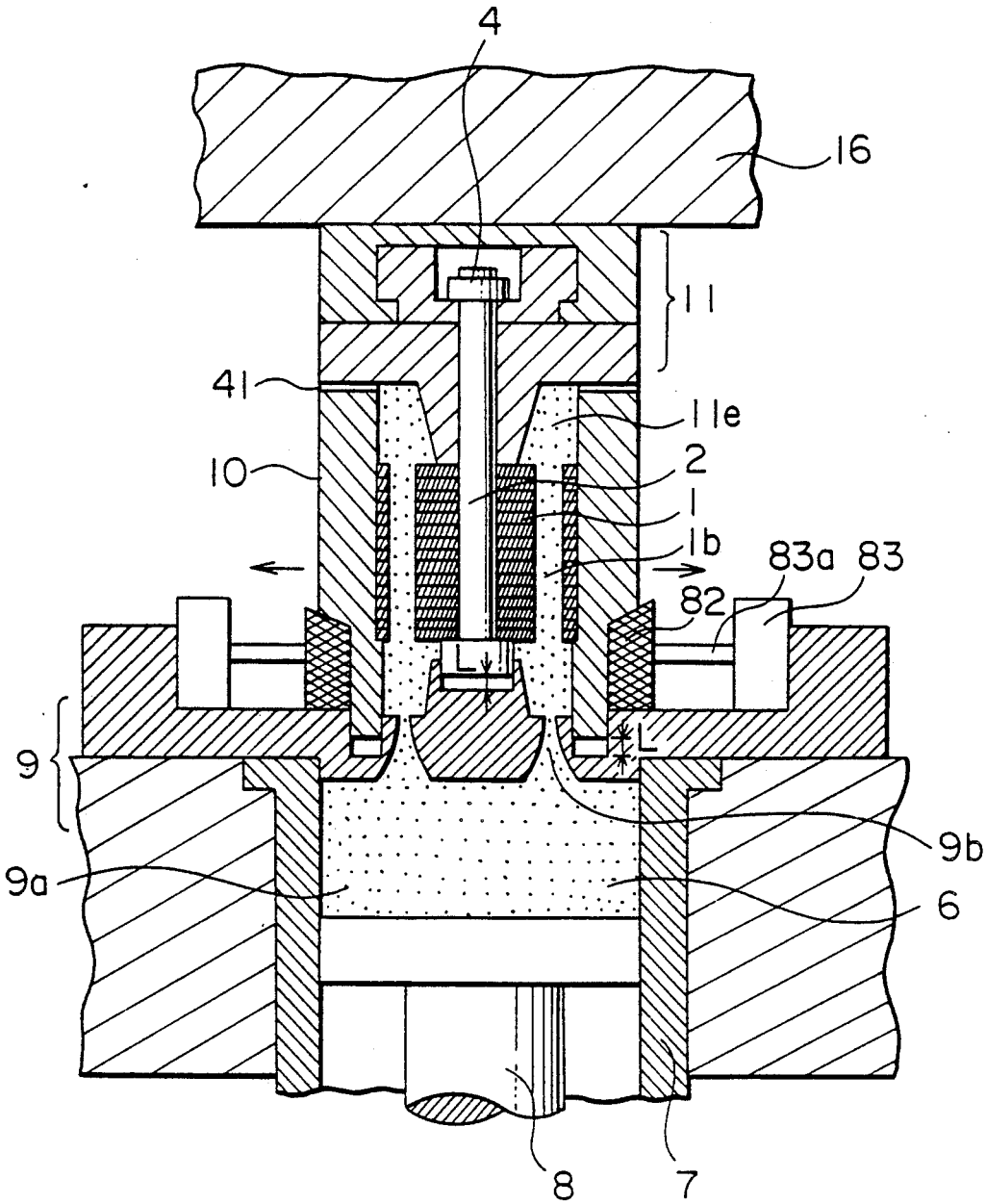

In each of Embodiments 16–17, the spacer means 82 is disposed between the bottom of the intermediate die 10 and the top of the bottom die 9 so as to separate them. However, as shown in FIG. 27, the bottom portion of the intermediate die 10 may be slidably engaged with the top portion of the bottom die 9. In this arrangement, even if the spacer means 82 is withdrawn, the molten conductive material 6 does not leak and the withdrawal devices 83 for actuating the spacer means 82 need not be moved up and down.

While the invention has been particularly shown and described with reference to the preferred embodiments thereof, it will be understood by those skilled in the art that the foregoing and other changes in form and details can be made therein without departing from the spirit and scope of the invention.

What is claimed is:

1. A method of manufacturing a defect-free cast product comprising the steps of:

forming a cavity surrounded by a plurality of dies;

charging molten conductive material into said cavity;

applying pressure to said conductive material by pressure means;

discharging gas from said conductive material by a gas discharge means; and selectively applying additional pressure to the portion of said conductive material which may suffer shrinkage cavities due to delay in solidification, by utilizing the pressure applied by said pressure means and by relatively moving a portion of said dies with respect to said conductive material during the entire time required for solidification when said conductive material solidifies and shrinks, whereby pressure is applied to the entire cast product to prevent occurrence of said shrinkage cavities, and absorbing movement during solidification between said plurality of dies with a movement absorbing member engaged with at least one of said plurality of dies.

2. A method according to claim 1, wherein said plurality of dies includes a top die and a bottom die, said top die being moved by moving said bottom die, toward said top die.

3. A method according to claim 1, wherein said bottom die is provided with a gate.

4. A method of manufacturing a defect-free cast product comprising the steps of:

forming a cavity surrounded by a plurality of dies, said plurality of dies includes a bottom die and an intermediate die, a movement absorbing member being disposed in a portion where said bottom die and said intermediate die are engaged with each other;

charging molten conductive material into said cavity;
applying pressure to said conductive material by pressure means; and
selectively applying additional pressure to the portion of said conductive material which may suffer shrinkage cavities due to delay in solidification, by utilizing the pressure applied by said pressure means and by relatively moving a portion of said dies with respect to said conductive material when said conductive material solidifies and shrinks, whereby pressure is applied to the entire cast product to prevent occurrence of said shrinkage cavities.

5. A method of manufacturing a defect-free cast product comprising the steps of:
forming a cavity surrounded by a plurality of dies wherein said plurality of dies includes a top die and an intermediate die, a movement absorbing member being disposed in a portion where said top die and said intermediate die are engaged with each other;
charging molten conductive material into said cavity;
applying pressure to said conductive material by pressure means;
discharging gas from said conductive material by a gas discharge means; and
selectively applying additional pressure to the portion of said conductive material which may suffer shrinkage cavities due to delay in solidification, by utilizing the pressure applied by said pressure means and by relatively moving a portion of said dies with respect to said conductive material during the entire time required for solidification when said conductive material solidifies and shrinks, whereby pressure is applied to the entire cast product to prevent occurrence of said shrinkage cavities.

6. A method according to claim 5, wherein said movement absorbing member is provided with a mechanical movement mechanism.

7. A method of manufacturing a squirrel-cage rotor comprising the steps of:
forming a cavity including a gas discharge means by arranging a plurality of dies around a rotor core;
charging molten conductive material into said cavity;
applying pressure to said conductive material by pressure means during the entire time required for solidification of the molten conductive material; and
selectively applying additional pressure to the portion of said conductive material which may suffer shrinkage cavities due to delay in solidification, by utilizing the pressure applied by said pressure means and discharging gas from said conductive material through said gas discharge means, thereby forming a slot conductor and end rings connected thereto and disposed on opposite end faces of said rotor core, and absorbing movement during solidification between said plurality of dies with a movement absorbing member engaged with at least one of said plurality of dies.

8. A method according to claim 7, wherein said step of selectively applying pressure to said conductive material is effected by utilizing the pressure of said pressure means and by moving at least one die so as to reduce the interval between said dies.

9. A method of manufacturing a squirrel-cage rotor comprising the steps of:
forming a cavity by arranging a plurality of dies around a rotor core;
charging molten conductive material into said cavity;
applying pressure to said conductive material by pressure means; and
selectively applying additional pressure to the portion of said conductive material which may suffer shrinkage cavities due to delay in solidification, by utilizing the pressure applied by said pressure means and by moving said rotor core in said dies, thereby forming a slot conductor and end rings connected thereto and disposed on opposite end faces of said rotor core.

10. A method according to claim 9, wherein said step of moving said rotor core is effected by utilizing a differential pressure which occurs between the opposite ends of said rotor core when said conductive material solidifies, whereby pressure is applied to end ring portions positioned on the opposite ends of said rotor core, said rotor core being fitted into a temporary holding shaft and held in position with a predetermined interval defined between said rotor core and the top of said temporary holding shaft so that said rotor core can move along the axis thereof, said temporary holding shaft being secured to said top die.

11. A method according to claim 10, wherein a spacer is disposed within said predetermined interval.

12. A method according to claim 9, wherein said temporary holding shaft is movably held on said top die, said rotor core and said temporary holding shaft being arranged to move upwardly when said conductive material solidifies.

13. A method according to claim 12, wherein a weight for preventing said temporary holding shaft from moving when said conductive material is charged is disposed on the top of said temporary holding shaft.

14. A method according to claim 10, wherein means for preventing said temporary holding shaft from moving along said temporary holding shaft axially in the upward direction when said conductive material is charged is disposed on the top of said temporary holding shaft.

15. A method according to claim 10, wherein means for preventing said temporary holding shaft from moving along said temporary holding shaft axially in the upward direction when said conductive material is charged is disposed on said dies.

16. A method of manufacturing a squirrel-cage rotor comprising the steps of:
forming a cavity by arranging a plurality of dies around a rotor core;
charging molten conductive material into said cavity;
applying pressure to said conductive material by pressure means; and
selectively applying additional pressure to the portion of said conductive material which may suffer shrinkage cavities due to delay in solidification, by utilizing the pressure applied by said pressure means and by moving said rotor core and said temporary holding shaft in said dies, thereby forming a slot conductor and end rings connected thereto and disposed on opposite end faces of said rotor core.

17. A method according to claim 16, wherein said temporary holding shaft is provided with a temporary cover, said temporary holding shaft, said temporary cover and said rotor core being integrally formed into a floating core which moves axially upwardly.

18. A method according to claim 17, wherein a weight is disposed on the top of said temporary holding shaft.

19. A method of manufacturing a squirrel-cage rotor comprising the steps of:

forming a cavity by arranging a plurality of dies around a rotor core;

charging molten conductive material into said cavity;

applying pressure to said conductive material by pressure means; and selectively applying additional pressure to the portion of said conductive material which may suffer shrinkage cavities due to delay in solidification, by utilizing the pressure applied by said pressure means thereby forming a slot conductor and end rings connected thereto and disposed on opposite end faces of said rotor core, and where end-ring pressure means provided with a spring is disposed on the inner side of said top die which comes into contact with said conductive material, pressure being selectively applied to said conductive material owing to the resisting force of said spring which occurs when pressure is applied by said pressure means.

20. A method of manufacturing a squirrel-cage rotor comprising the steps of:

forming a cavity including a gas discharge means by arranging a plurality of dies around a rotor core;

charging molten conductive material into said cavity;

applying pressure to said conductive material by pressure means during the entire time required for solidification of the molten conductive material; and selectively applying additional pressure to the portion of said conductive material which may suffer shrinkage cavities due to delay in solidification, by utilizing the pressure applied by said pressure means and discharging gas from said conducive material through said gas discharge means, thereby forming a slot conductor and end rings connected thereto and disposed on opposite end faces of said rotor core wherein said step of selectively applying pressure to said conductive material is effected by utilizing the pressure of said pressure means and by moving at least one die so as to reduce the interval between said dies and wherein the step of moving said at least one die is performed while absorbing movement of said dies by means of a movement absorbing member, said movement absorbing member being disposed in a portion where said top die and said bottom die are engaged with each other.

21. A method of manufacturing a squirrel-cage rotor comprising the steps of:

forming a cavity including a gas discharge means by arranging a plurality of dies around a rotor core, said rotor core being fitted into a temporary holding shaft and held in a position with a predetermined interval defined between said rotor core and the top of said holding shaft;

charging molten conductive material into said cavity;

applying pressure to said conductive material by pressure means during the entire time required for solicitation of the molten conductive material; and selectively applying additional pressure to the portion of said conductive material which may suffer shrinkage cavities due to delay in solidification, by utilizing the pressure applied by said pressure means and discharging gas from said conductive material through said gas discharge means, thereby forming a slot conductor and end rings connected thereto and disposed on opposite end faces of said rotor core wherein said step of selectively applying pressure to said conductive material is effected by utilizing the pressure of said pressure means and by moving at least one die so as to reduce the interval between said dies and wherein movement absorbing members are respectively disposed on the portions of said temporary holding shaft which are positioned in a top end ring portion and a bottom end ring portion, the amount of shrinkage of said conductive material due to solidification being absorbed by said movement absorbing members.

22. A method of manufacturing a squirrel-cage rotor comprising the steps of:

forming a cavity including a gas discharge means by arranging a plurality of dies around a rotor core;

charging molten conductive material into said cavity;

applying pressure to said conductive material by pressure means during the entire time required for solidification of the molten conductive material; and selectively applying additional pressure to the portion of said conductive material which may suffer shrinkage cavities due to delay in solidification, by utilizing the pressure applied by said pressure means and discharging gas from said conductive material through said gas discharge means, thereby forming a slot conductor and end rings connected thereto and disposed on opposite end faces of said rotor core wherein said step of selectively applying pressure to said conductive material is effected by utilizing the pressure of said pressure means and by moving at least one die so as to reduce the interval between said dies and wherein said top die and said bottom die are respectively provided with cores each having a movement absorbing member, the amount of shrinkage of said conductive material due to solidification being absorbed by said movement absorbing members.

23. A method of manufacturing a squirrel-cage rotor comprising the steps of:

forming a cavity including a gas discharge means by arranging a plurality of dies around a rotor core;

charging molten conductive material into said cavity;

applying pressure to said conductive material by pressure means during the entire time required for solidification of the molten conductive material; and selectively applying additional pressure to the portion of said conductive material which may suffer shrinkage cavities due to delay in solidification, by utilizing the pressure applied by said pressure means and discharging gas from said conductive material through said gas discharge means, thereby forming a slot conductor and end rings connected thereto and disposed on opposite end faces of said rotor core wherein said step of selectively applying pressure to said conductive material is effected by utilizing the pressure of said pressure means and by moving at least one die so as to reduce the interval between said dies and wherein a movement absorbing member is disposed on said top die via a core, while said bottom die is provided with an inward gate capable of achieving directional solidification which starts from an upper portion thereof, the amount of shrinkage of said conductive material due to solidification being absorbed by said movement absorbing member.

24. A method of manufacturing a squirrel-cage rotor comprising the steps of:

forming a cavity by arranging a plurality of dies around a rotor core;

charging molten conductive material into said cavity;

applying pressure to said conductive material by pressure means; and selectively applying additional pressure to the portion of said conductive material which may suffer shrinkage cavities due to delay in solidification, by utilizing the pressure applied by said pressure means and by moving at least one die so as to reduce the interval between said dies, thereby forming a slot conductor and end rings connected thereto and disposed on opposite end faces of said rotor core, wherein said step of moving said at least one die is performed while reducing an interval between said dies by withdrawing removable spacer means in accordance with the shrinkage of said conductive material which occurs when said conductive material solidifies under pressure, said removable spacer means being disposed between said dies.

25. A method according to claim 24, wherein said spacer means has a wedge-like configuration in cross section.

26. A method according to claim 24, wherein said dies are partially engaged with each other.

* * * * *

UNITED STATES PATENT AND TRADEMARK OFFICE

CERTIFICATE OF CORRECTION

PATENT NO. : 5,067,550

DATED : NOVEMBER 26, 1991

INVENTOR(S) : MAEKAWA ET AL.

It is certified that error appears in the above-identified patent and that said Letters Patent is hereby corrected as shown below:

On the title page:

Item no. [54], Title, change "CASTING" to --CAST--.

Item no. [56], References Cited, one patent was omitted --4,760,300 7/1988 U.S.--.

Claim 2, column 24, line 57, after "die" delete ",".

Claim 19, column 27, line 17, after "core" delete ",".

line 22, change "resisting" to --restoring--.

Claim 20, column 27, line 38, change "conducive" to --conductive--

Claim 21, column 27, line 63, change "solicitation" to --solidification--.

Signed and Sealed this

Sixth Day of April, 1993

*Attest:*

STEPHEN G. KUNIN

*Attesting Officer*

*Acting Commissioner of Patents and Trademarks*